US006106176A

United States Patent [19]

Yanagisawa et al.

[11] Patent Number: 6,106,176

[45] Date of Patent: Aug. 22, 2000

[54] PRINTING METHOD AND APPARATUS

[75] Inventors: Shigekazu Yanagisawa, Matsumoto; Yoshio Karasawa, Yamagata-mura; Kenji Watanabe, Tokyo; Tomoyuki Ichikawa, Tokyo; Kenichi Tanabe, Tokyo; Rie Sudo, Tokyo, all of Japan

[73] Assignee: Seiko Epson Corporation, Tokyo, Japan

[21] Appl. No.: 09/257,856

[22] Filed: Feb. 25, 1999

[30] Foreign Application Priority Data

Mar. 20, 1998 [JP] Japan ..... 10-092418

[51] Int. Cl.[7] ..... B41J 11/26

[52] U.S. Cl. ..... 400/615.2; 400/279; 400/76; 400/70; 400/61

[58] Field of Search ..... 400/279, 615.2, 400/76, 70, 61, 283

[56] References Cited

U.S. PATENT DOCUMENTS

| | | | |
|---|---|---|---|
| 3,953,774 | 4/1976 | Sato et al. | 318/594 |
| 4,054,819 | 10/1977 | Johnson | 318/269 |
| 4,538,096 | 8/1985 | Kern | 318/314 |
| 4,749,927 | 6/1988 | Rodal et al. | 318/599 |
| 5,454,653 | 10/1995 | Miwa | 400/582 |
| 5,868,504 | 2/1999 | Nunokawa et al. | 400/61 |

FOREIGN PATENT DOCUMENTS

| | | | |
|---|---|---|---|
| 57-159675 | 10/1982 | Japan . | |
| 2-063777 | 3/1990 | Japan . | |
| 7285240 | 10/1995 | Japan | B41J 2/51 |
| 8230266 | 9/1996 | Japan | B41J 19/60 |
| 1465676 | 2/1977 | United Kingdom . | |
| WO97/18620 | 5/1997 | WIPO . | |

*Primary Examiner*—John S. Hilten
*Assistant Examiner*—Charles H. Nolan, Jr.
*Attorney, Agent, or Firm*—Hogan & Hartson LLP

[57] ABSTRACT

There are provided a method and apparatus for printing a print image on a print material by using a print head based on dot information of the print image by causing at least one of the print head and the print material to move to thereby effect relative motion between the print head and the print material at a relative speed dependent on a rotational speed of a DC motor as a drive source. Driving of the DC motor and the print head is controlled for printing of the print image. A distance from a predetermined length start position selected from a front end position, a print start position, and a print end position of the print material to a predetermined length end position at which the relative motion is to be terminated, is set to a predetermined length. Braking of the DC motor is controlled by varying a braking load on the DC motor in dependence on the relative speed and the predetermined length so as to terminate the relative motion at the predetermined length end position.

31 Claims, 23 Drawing Sheets

FIG. 17

| AMBIENT TEMPERATURET d (℃) | SPEED 1 0≦X<8 | SPEED 2 8≦X<9 | SPEED 3 9≦X |
|---|---|---|---|
| ~12.4 | Tstd1×1.5 | Tstd1×1.05 | Tstd1 |
| 12.5~17.4 | Tstd2×1.5 | Tstd2×1.05 | Tstd2 |
| 17.5~22.4 | Tstd3×1.5 | Tstd3×1.05 | Tstd3 |
| 22.5~27.4 | Tstd4×1.5 | Tstd4×1.05 | Tstd4 |
| 27.5~32.4 | Tstd5×1.5 | Tstd5×1.05 | Tstd5 |
| 32.5~37.4 | Tstd6×1.5 | Tstd6×1.05 | Tstd6 |
| 37.5~42.4 | Tstd7×1.5 | Tstd7×1.05 | Tstd7 |
| 42.5~ | Tstd8×1.5 | Tstd8×1.05 | Tstd8 |

PRINTING METHOD AND APPARATUS

BACKGROUND OF THE INVENTION

1. Field of the Invention

This invention relates to a printing method and apparatus which is capable of controlling a printing operation in a manner adapted to a fixed print length.

2. Prior Art

A printing apparatus generally employed with a word processor or the like usually prints on paper cut to a predetermined size(cut sheet). To print on such cut sheets, the size of paper to be printed by the printing apparatus is set to a selected standard size or an arbitrarily set size, which is equal to the predetermined size, and a print range (length of a print area in the direction of feed of the paper (printing length) and length of the same in the direction of a lateral line of printed characters) or margin widths (margin lengths) in longitudinal (front-rear) and lateral directions are set to predetermined values, and then a desired print image is printed according to the predetermined values.

There is also used another type of printing apparatus which principally prints on a continuous sheet of paper over a desired length. A typical example of this type of printing apparatus is a tape printing apparatus. Some of tape printing apparatuses are also known to be capable of forming a label or the like which has a predetermined length by setting length (tape length) of a print material (tape) and front and rear margins (front margin length and rear margin length) of the same and after the printing, cutting off the tape at a predetermined cutting position.

In addition to these printing apparatuses, facsimile machines can be also classified into the above two types of printing apparatuses. That is, a type of facsimile machine which prints the received facsimile image on a sheet of paper having a predetermined size can be counted among the printing apparatuses of the first-mentioned type (which prints on cut sheets) while another type which prints the received facsimile image on a roll of continuous paper to be dispensed among the printing apparatuses of the second-mentioned type (which prints on a continuous sheet of paper). Further, a type of cash register which prints details of prescribed items (image thereof) on a sheet of receipt and provides a predetermined margin thereafter is classified into the latter type, and a ticket machine which prints an image of predetermined contents of a ticket on a continuous sheet of paper and then cut off the sheet for delivery is also classified into the latter type.

These types of printing apparatuses require accurate position control, in other words, a so-called fixed length control for adapting a printing operation to a predetermined length of a print material (print medium). More specifically, it is required that based on a definite length of the print material (length in the direction of feed of the paper (cut sheet) in the case of the former type and length from a front end of the paper (continuous sheet) to a cutting position of the same in the case of the latter type), a front margin length, a print length, and a rear margin length, first, a front margin is set from the front end of the print material, and printing is started from a print start position or the rear end of the front margin, and carried out through the print length, followed by providing the rear margin. In the case of the latter type, it is further required that the print material is cut at the cutting position which is set to the rear end of the rear margin.

To attain the accurate fixed length control, many of the printing apparatuses employ, a stepping motor (pulse motor) which can be controlled in respect of speed (constant speed control) based on the number of pulses, a so-called DC servomotor which incorporates a constant speed control circuit, or the like, as a drive source for driving relative motion means for moving at least one of the print head and the print material relative to the other, to thereby cause relative motion between them at a constant or controlled speed of the relative motion from the start of the motion.

That is, since the speed of the relative motion is constant, the printing of the print image is started when a predetermined time period corresponding to the predetermined front margin length elapses after the time point of the start of the relative motion between the print head and the print material, to continue the printing through the predetermined print length at the constant speed, and then the relative motion between the print head and the print material is carried out for a time period corresponding to the predetermined rear margin length to stop the relative motion between them.

Particularly as to the latter type, to cut off the print material at a cutting position where the relative motion for the printing of the print material is stopped, the print material is required to be stopped accurately at the stop position adapted to the predetermined print length, and hence, the stepping motor is generally employed as the drive source for this type of printing apparatus. More specifically, in this case, not only the constant speed control but also accurate stopping control is necessitated, and therefore, the stepping motor is employed since it can cause the printing operation to be stopped accurately at a desired position only by stopping the supply of pulses.

As described above, in the conventional printing apparatuses, as the drive source for carrying out the fixed length control (print control, position control, and speed control), a relatively expensive motor, such as a stepping motor, is required to be used, and this hinders the manufacturing costs of the printing apparatuses from being reduced.

On the other hand, when a DC motor, which is relatively inexpensive, is used as the drive source for driving means for the relative motion between the print head and the print material, since the DC motor does not have a control circuit for constant speeds, it cannot attain the constant speed of the relative motion. Particularly, when the printing is started or terminated, the speed of relative motion undergoes large variation due to acceleration at the start of printing and deceleration at the termination of the same, and hence it is impossible to apply the above-mentioned position control (print control and fixed length control) to be executed under the constant speed of the relative motion between the print head and print material.

Further, to stop the relative motion, it is required to turn off the DC motor, but only the turning-off of the DC motor is not enough for causing the relative motion to be stopped at the stop position adapted to the predetermined print length, since the DC motor continues to rotate for some time by inertia. Particularly, in the latter case (using the continuous sheet), the print material should be cut off by setting the stop position to a position where the print material is cut off, and hence incapability of stoppage at the position adapted to the predetermined print length, that is, implies incapability of the fixed length control, causes a large problem.

SUMMARY OF THE INVENTION

It is an object of the invention to provide a printing method and apparatus which is capable of controlling printing in a manner adapted to a predetermined length set for a print material without increasing the manufacturing cost of the apparatus.

To attain the object, according a first aspect of the invention, there is provided a method of printing a print image on a print material by using a print head based on dot information of the print image by causing at least one of the print head and the print material to move to thereby effect relative motion between the print head and the print material at a relative speed dependent on a rotational speed of a DC motor as a drive source.

The method according to the first aspect of the invention is characterized by comprising the steps of:

controlling driving of the DC motor and the print head for printing of the print image;

setting a distance from a predetermined length start position selected from a front end position, a print start position, and a print end position of the print material to a predetermined length end position at which the relative motion is to be terminated, to a predetermined length; and controlling braking of the DC motor by varying a braking load on the DC motor in dependence on the relative speed and the predetermined length so as to terminate the relative motion at the predetermined length end position.

To attain the above object, according to a second aspect of the invention, there is provided a printing apparatus comprising:

a DC motor as a drive source;

printing means having a print head, the printing means printing, based on dot information of a print image, the print image on a print material;

relative motion means driven by the DC motor for causing at least one of the print head and the print material to move to thereby effect relative motion between the print head and the print material at a relative speed dependent on a rotational speed of the DC motor;

drive control means for controlling driving of the DC motor and the print head for printing of the print image;

fixed length-setting means setting a distance from a predetermined length start position selected from a front end position, a print start position, and a print end position of the print material to a predetermined length end position at which the relative motion is to be terminated, to a predetermined length; and control means for controlling braking of the DC motor by varying a braking load on the DC motor in dependence on the relative speed and the predetermined length so as to terminate the relative motion at the predetermined length end position.

According to the printing method and apparatus, a print image is printed on a print material based on dot information of the print image by using a print head while moving at least one of the print head and the print material relative to the other at a relative speed dependent on a DC motor as a drive source. Further, a distance from a predetermined length start position of the print material to a predetermined length end position at which the relative motion is to be terminated, is set to a predetermined length, and the braking load is changed in dependence on the predetermined length and the relative speed.

By changing the braking load on the DC motor, the braking time from the timing of starting the braking of the DC motor to the timing of completely stopping the relative motion can be changed, whereby it is possible to control the length of a relative position of the print head relative to the print material at which the braking is started to a relative position of the same at which the relative motion is stopped, i.e. the braking distance.

Further, since the braking load is changed according to the relative speed, the printing can be adapted to a desired braking distance even if the relative speed is not constant (varied). Since the braking load is changed according to the predetermined length, it is possible to switch between quick braking and slow braking in dependence on whether the predetermined length is short or long or carry out multi-stage breaking in dependence on the distance up to the predetermined length end position, whereby the freedom of the braking control can be enhanced.

Through these advantages of the braking control realized by the invention, the printing method and apparatus is capable of stopping the relative motion between the print head and the print material at the predetermined length end position adapted to the predetermined length set as desired. As a result, it is possible to control the printing operation in a manner adapted to any of various kinds of predetermined lengths set for printing on the print material and at the same reduce the manufacturing costs through the merit of using the DC motor as a drive source.

Preferably, the step of controlling the braking of the DC motor comprises the steps of:

setting a braking distance over which the braking of the DC motor is carried out based on the predetermine length and the relative speed, the braking distance starting from a brake start position at which the breaking of the DC motor is started and terminating at the predetermined length end position; and starting the braking of the DC motor based on the predetermined length and the braking distance.

Preferably, the control means includes:

braking distance-setting means for setting a braking distance over which the braking of the DC motor is carried out based on the predetermine length and the relative speed, the braking distance starting from a brake start position at which the breaking of the DC motor is started and terminating at the predetermined length end position; and braking start means for starting the braking of the DC motor based on the predetermined length and the braking distance.

According to these preferred embodiments, the braking distance from a brake start position at which the breaking of the DC motor is started to the predetermined length end position over which the braking of the DC motor is carried out is set based on the predetermine length and the relative speed, and based on the predetermined length and the braking distance, the braking of the DC motor is started. This enables a predetermined length end position defined as a position distant from the predetermined length start position by the predetermined length and a predetermined length end position defined as a position distant from the braking start position by the braking distance to be coincident with each other.

For instance, when the predetermined length is large, it is possible to carry out slow braking or multi-stage braking in a manner adapted to the predetermined length end position. Therefore, the relative motion between the print head and the print material can be stopped by setting the braking distance according to the relative speed, and changing the braking load in a manner adapted thereto. On the other hand, if the predetermined length is small, it is required to stop the relative motion within the small predetermined length, and hence the quick braking is carried out by adapting the braking distance to the small predetermined length.

That is, according to these preferred embodiments, the freedom of the braking control is enhanced since it is possible to switch between the quick braking and the slow braking in dependence on the whether the predetermined length is large or small, or carry out multi-stage braking according to the length up to the predetermined length end position, whereby the braking control can be carried out in a manner adapted to any of various kinds of the predetermined lengths set for printing on the print material.

More preferably, when the braking distance is longer than a distance from the print end position to the predetermined length end position, the braking of the DC motor includes preliminary braking carried out before completion of the printing of the print image and final braking carried out after the completion of the printing.

When the braking distance is longer than a length from the print end position to the predetermined length end position, that is, the braking distance is longer than a so-called rear margin length, it is impossible to terminate the relative motion unless the braking is started during execution of the printing. According to the preferred embodiment, the baking of the DC motor includes preliminary braking carried out before completion of the printing of the print image and final braking carried out after the completion of the printing. This makes it possible to stop the relative motion at the predetermined length end position by the final braking carried out after the printing, through reducing the relative speed to a suitable value for the braking distance by the preliminary braking before completion of the printing. As a result, the printing operation can be carried out in a manner adapted to the predetermined length with even higher accuracy.

More preferably, the step of controlling the braking of the DC motor further includes the step of setting timing of setting the braking distance based on at least one of the dot information of the print image and the predetermined length.

More preferably, the control means further includes braking distance-setting timing-setting means for setting timing of setting the braking distance based on at least one of the dot information of the print image and the predetermined length.

According to these preferred embodiments, the braking distance is set based on the predetermined length and the relative speed, and the braking of the DC motor is started based on the predetermined length and the braking distance. The setting of the braking distance is only required to be timed to a time point before the start of the braking. However, from the viewpoint of the accuracy of the braking distance, it is preferred that the braking distance is set based on the relative speed at a time point close to (just before) the time point at which the braking is started, and further this manner of setting the braking distance makes it unnecessary to store a value of the braking distance thus set for a long time period since the braking can be started immediately after setting the braking distance, which improves efficiency of the printing control.

On the other hand, when the length from the front end position of the print material to the stop position as the predetermined length end position is set to the predetermined length, the predetermine length includes a front margin length, a print length, and a rear margin length. This makes it possible to set the timing of setting the braking distance and the timing of starting the braking based on the dot information of the print image and the predetermined length irrespective of whether the rear margin length is long or short. Particularly, by controlling the printing operation adapted to the predetermined length e.g. based on the number of remaining lines of dots of the print image included in the dot information of the print image, the controlling operations can be carried out more efficiently, since the relationship between the printing control and the braking control is specific and definite. The same advantageous effects can be obtained when the predetermined length is set to a length starting from the print start position.

Further, when the predetermined length is set to a length starting from the print end position, assuming that the predetermined length is long, it is possible to set the timing of setting the braking distance and the timing of starting the braking based on the predetermined length, i.e. the rear margin length. On the other hand, if the rear margin length as the predetermined length is short, it is preferred that the braking distance is set based on the dot information of the print image preceding the rear margin length, since it is possible to set the timing in a more suitable manner, and allows the braking to be carried out on the safe side.

Therefore, according to the preferred embodiments, by setting the timing of setting the braking distance based on the dot information of the print image and/or the predetermined length, it is possible to set the braking distance more suitably, more accurately, and more efficiently, and this enables the printing operation to be controlled in a more suitably adapted to the predetermined length set for printing on the print material.

Preferably, the step of controlling the braking of the DC motor includes changing timing of printing each line of dots in dependence on a change of the relative speed.

Preferably, the control means includes print timing-changing means for changing timing of printing each line of dots by the print head in dependence on a variation in the relative speed.

According to these preferred embodiments, the timing of printing each line of dots of the print image by the print head is changed based on the predetermined length according to a variation in the relative speed. That is, the timing of printing is changed based on the predetermined length according to the change in the relative speed, whereby it is possible to print the print image in a manner adapted to the front margin length, print length, and rear margin length set in a predetermined manner based on the predetermined length even if the relative speed is not constant (changed).

Preferably, the method includes the step of cutting off the print material at the predetermined length end position.

Preferably, the printing apparatus further includes cutting means for cutting off the print material at the predetermined length end position.

According to these preferred embodiments, the print material is cut at the predetermined length end position. Therefore, the invention can be applied not only to cut sheets of paper but also to a continuous sheet of paper.

For instance, the print material is a tape.

According to the preferred embodiment, since the print material is a tape, the invention can be applied to a tape printing apparatus.

Preferably, the braking load includes driving of the DC motor in a reverse direction.

Preferably, the control means includes means for driving the DC motor in a reverse direction as the braking load.

According to these preferred embodiments, a large braking load can be applied to effect a sudden stop.

Preferably, the braking load includes a plurality of resistances for selective connection in a circuit via which power is supplied to the DC motor.

Preferably, the printing apparatus includes a circuit via which power is supplied to the DC motor, and the braking load includes a plurality of resistances for selective connection in the circuit.

According to these preferred embodiments, it is possible to apply a braking load selected from a plurality of braking loads. Therefore, it is possible to carry out braking in a manner more accurately controlled and suitably adapted to the situation.

Preferably, the braking load is changed based on data of actual measurement of effects on the relative motion caused by the driving of the DC motor in the reverse direction and the selective connection of the plurality of resistances.

Preferably, the control means changes the braking load based on data of actual measurement of effects on the relative motion caused by the driving of the DC motor in the reverse direction and the selective connection of the plurality of resistances.

According to these preferred embodiments, since the braking load is changed based on the data of the actual measurement, it is possible to carry out the braking control in a reliable manner.

Preferably, the variation in the relative speed is detected based on detection of the relative speed by using a sensor.

Preferably, the printing apparatus includes a sensor for detecting the relative speed to detect the variation in the relative speed based thereon.

According to these preferred embodiments, since the relative speed is actually detected, it is possible to carry out the braking control in a manner more suitably adapted to the actual situation.

The above and other objects, features, and advantages of the invention will become more apparent from the following detailed description taken in conjunction with the accompanying drawings.

BRIEF DESCRIPTION OF THE DRAWINGS

FIG. 17 is a diagram showing an example of parameter data when the pulse-applying time period is used as a parameter;

DETAILED DESCRIPTION

The invention will now be described in detail with reference to drawings showing embodiments thereof. In these embodiments, a printing method and device according to the invention are applied to a tape printing apparatus.

The tape printing apparatus 1 is capable of printing desired characters, figures and the like on a printing tape (tape) T as well as cutting off the printed portion of the tape T to thereby produce a label. The tape T is loaded in the tape printing apparatus 1 in a state received within a tape cartridge 5 therefor.

Figure 1:
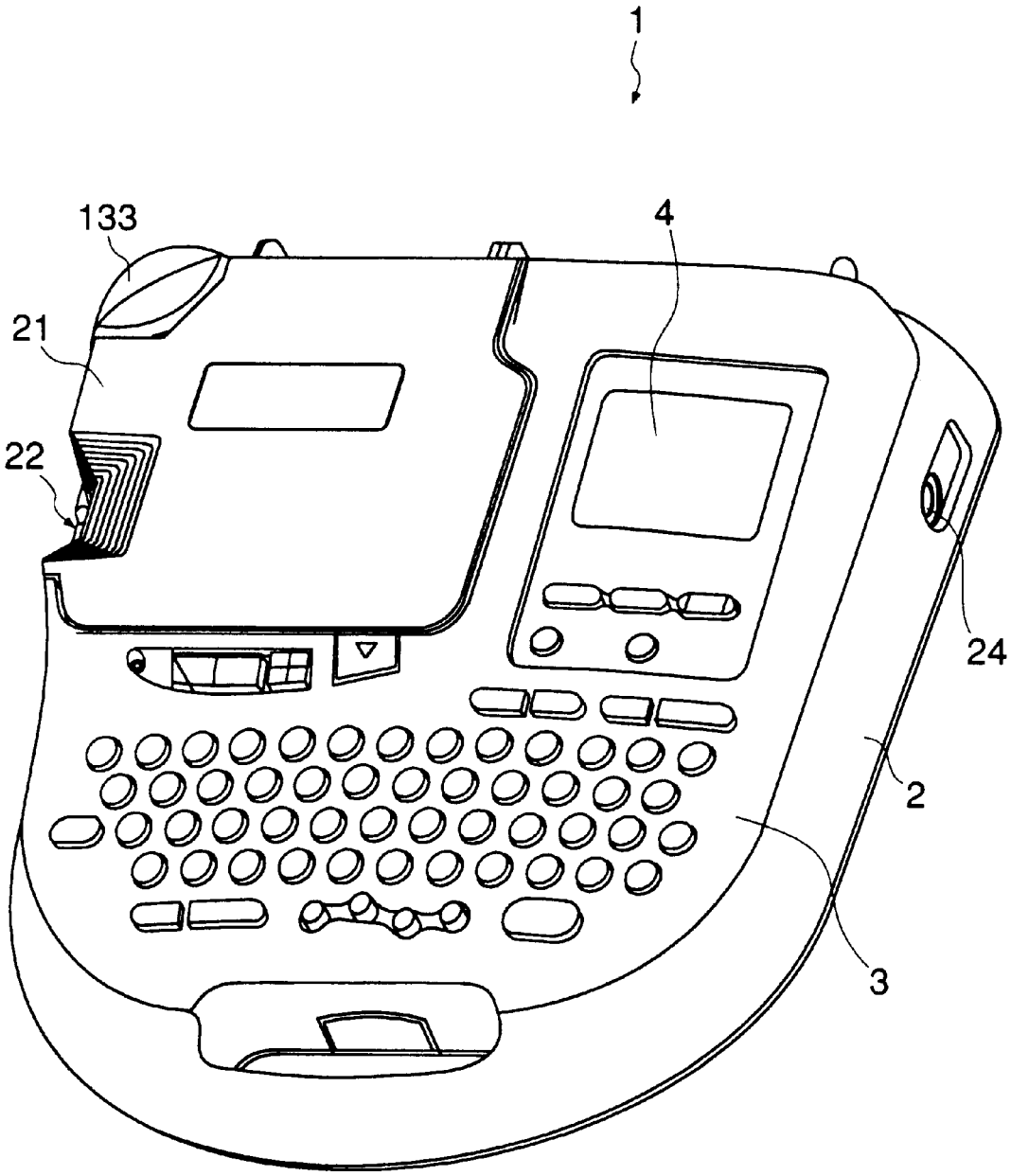
FIG. 1 is a perspective view of an appearance of a tape printing apparatus according to an embodiment of the invention.

FIG. 1 is a perspective view of an appearance of the tape printing apparatus 1. As shown in the figure, the tape printing apparatus 1 includes a casing 2 having upper and lower divisional portions. The casing 2 has a keyboard 3 arranged on the top of the front portion thereof and a lid 21 and a display 4 arranged on the left-hand side and the right-hand side of the top of the rear portion thereof. The keyboard 3 is comprised of various kinds of entry keys.

Figure 2:
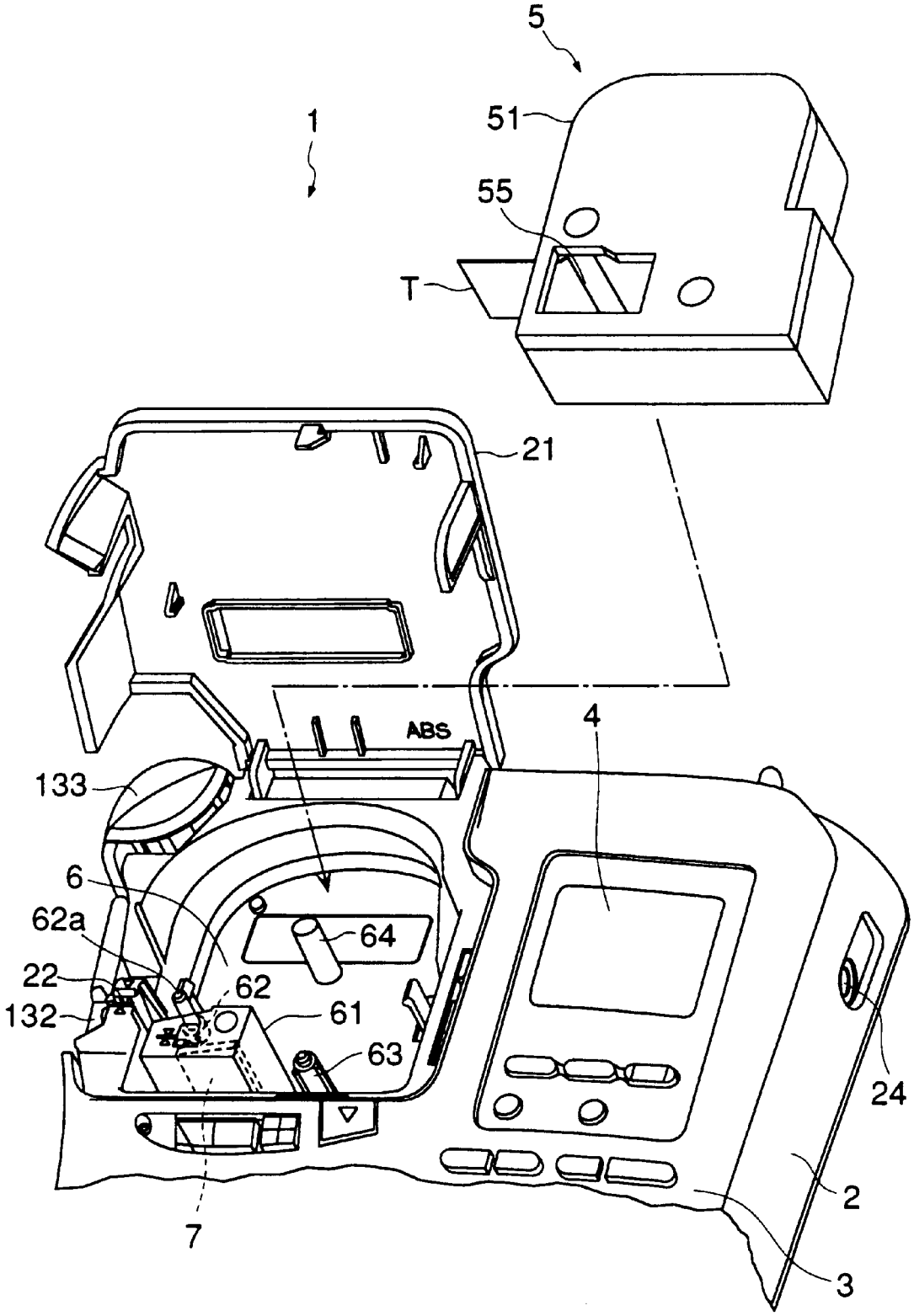
FIG. 2 is a partial perspective view of the FIG. 1 tape printing apparatus, in a state in which a lid of the tape printing apparatus is opened and a tape cartridge is removed therefrom.

As shown in FIG. 2, arranged under the lid 3 is a compartment 6 for loading the tape cartridge 5 therein. The tape cartridge 5 is mounted in and removed from the compartment 6 in a state of the lid 21 being opened.

The tape cartridge 5 contains a tape T having a predetermined width (approximately 4.5 to 48 mm). The tape cartridge 5 has a plurality of small holes formed in the bottom thereof for discrimination of a type of the tape T contained therein from the other types of the tape T having different widths, which are contained in other tape cartridges 5. The compartment 6 has a tape-discriminating sensor 142 (see FIG. 7), such as micro-switches and the like, for detecting these holes to thereby determine the type of a tape T.

The compartment 6 is provided with an ambient temperature sensor 143 (see FIG. 7), such as a thermistor, which sends information of an ambient temperature detected thereby to a control block 200 described hereinbelow. Further, the casing 2 has a left side portion thereof formed with a tape exit 22 for causing the compartment 6 and the outside of the apparatus to communicate with each other. On the tape exit 22 faces a tape cutter 132 for cutting a dispensed portion of the tape T (see FIG. 4).

Figure 7:
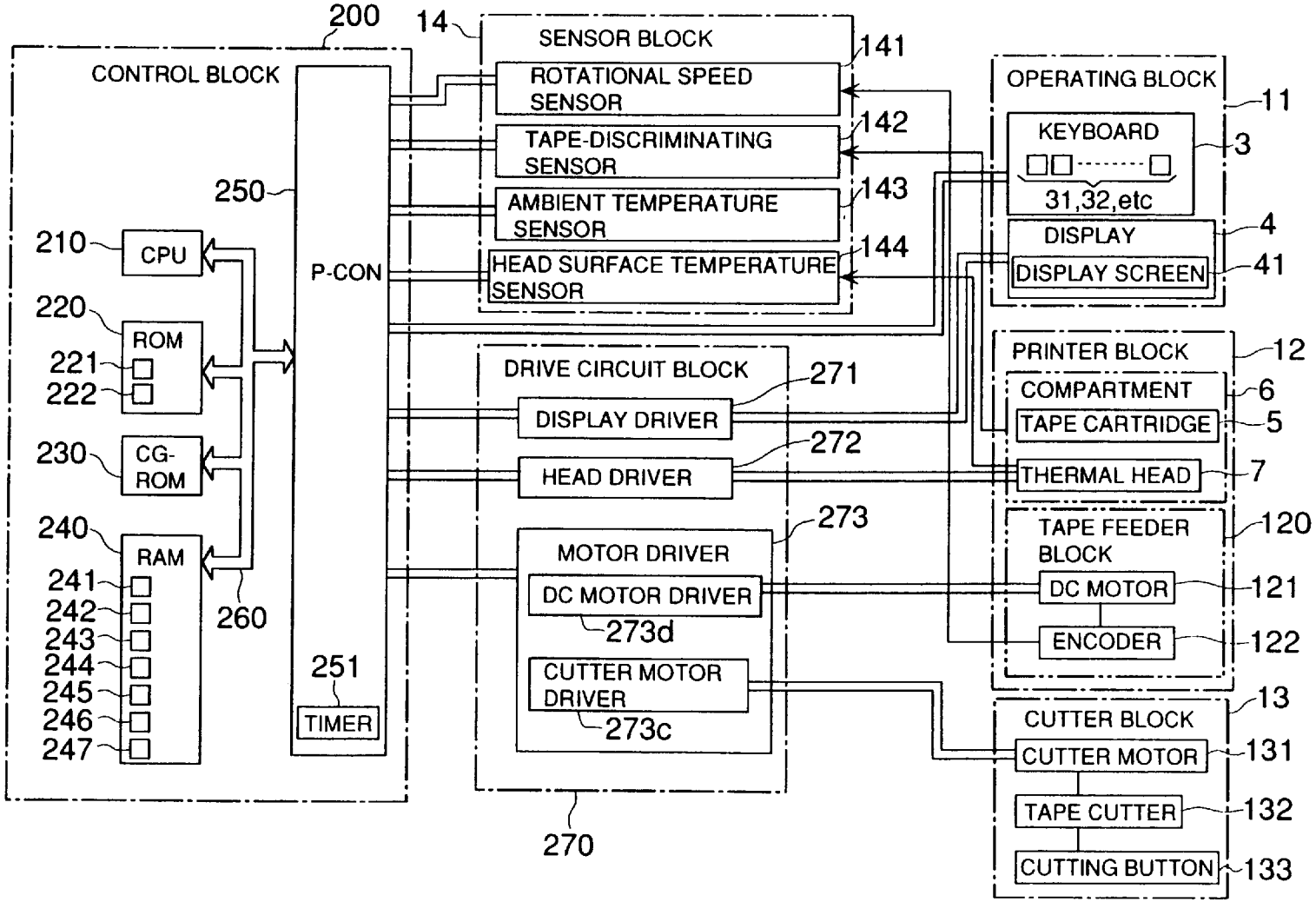
FIG. 7 is a block diagram schematically showing a control system of the FIG. 1 tape printing apparatus.

Referring to FIG. 7, the tape printing apparatus 1 is basically comprised of an operating block 11 having the keyboard 3 and the display 4 for interfacing with the user, a printer block 12 having a thermal head 7 and a tape feeder block 120 for printing on a tape T contained in the tape cartridge 5 loaded in the compartment 6, a cutter block 13 for cutting off the printed portion of the tape T after printing, a sensor block 14 having various sensors for carrying out various detecting operations, a drive circuit block 270 having drivers for driving respective circuits associated therewith, and the control block 200 for controlling operations of components of the tape printing apparatus 1 including the above-mentioned sensors and drivers.

To implement the above construction, the casing 2 accommodates a circuit board, not shown, in addition to the printer block 12, the cutter block 13, the sensor block 14 and so forth. On the circuit board are mounted a power supply unit, the circuits of the drive circuit block 270 and the control block 200, described hereinafter. The circuit board is connected to batteries, such as nicad batteries, which can be removably mounted within the casing 2 from outside, and a connector port 24 for connecting an AC adapter thereto.

In the tape printing apparatus 1, after loading the tape cartridge 5 in the compartment 6, the user enters printing information, such as desired characters (letters, numerals, symbols, simple figures, etc.) via the keyboard 3 and at the same time confirms or views the result of the entry on the display 4 for editing the printing information.

Thereafter, when the user instructs a printing operation via the keyboard 3, the tape feeder block 120 is driven to unwind a tape T from the tape cartridge 5, while the thermal head 7 is driven to print on the tape T as desired.

The printed portion of the tape T is delivered from the tape exit 22 as the printing proceeds. When the desired print is thus completed, the tape feeder block 120 sends the tape T to a position corresponding to termination of a tape length (the length of a label to be formed) including the length of margins, and then stops the feeding of the tape.

The cutter block 13 includes a tape cutter 132, a cutting button 133 for manually causing the tape cutter 132 to carry out a cutting operation in the case of a desired length printing, and a cutter motor 131 for driving the tape cutter 132 for an automatic cutting operation in the case of a fixed length printing (see FIG. 7). To selectively carry out the two types of cutting operations, the tape printing apparatus 1 is capable of switching between an automatic cutting mode and a manual cutting mode in response to a mode-setting operation.

More specifically, in the manual cutting mode, when the printing operation is completed, the user pushes the cutting button 133 arranged on a left-side rear portion of the casing 2 (see FIGS. 1 and 2), whereby the tape cutter 132 is actuated to cut the tape T to a desired length. Further, in the automatic cutting mode, after completion of the printing operation, the tape T is sent for incremental feed by the length of a rear margin, and then stopped, whereupon the cutter motor 131 is driven to cut off the tape T.

Figure 3:
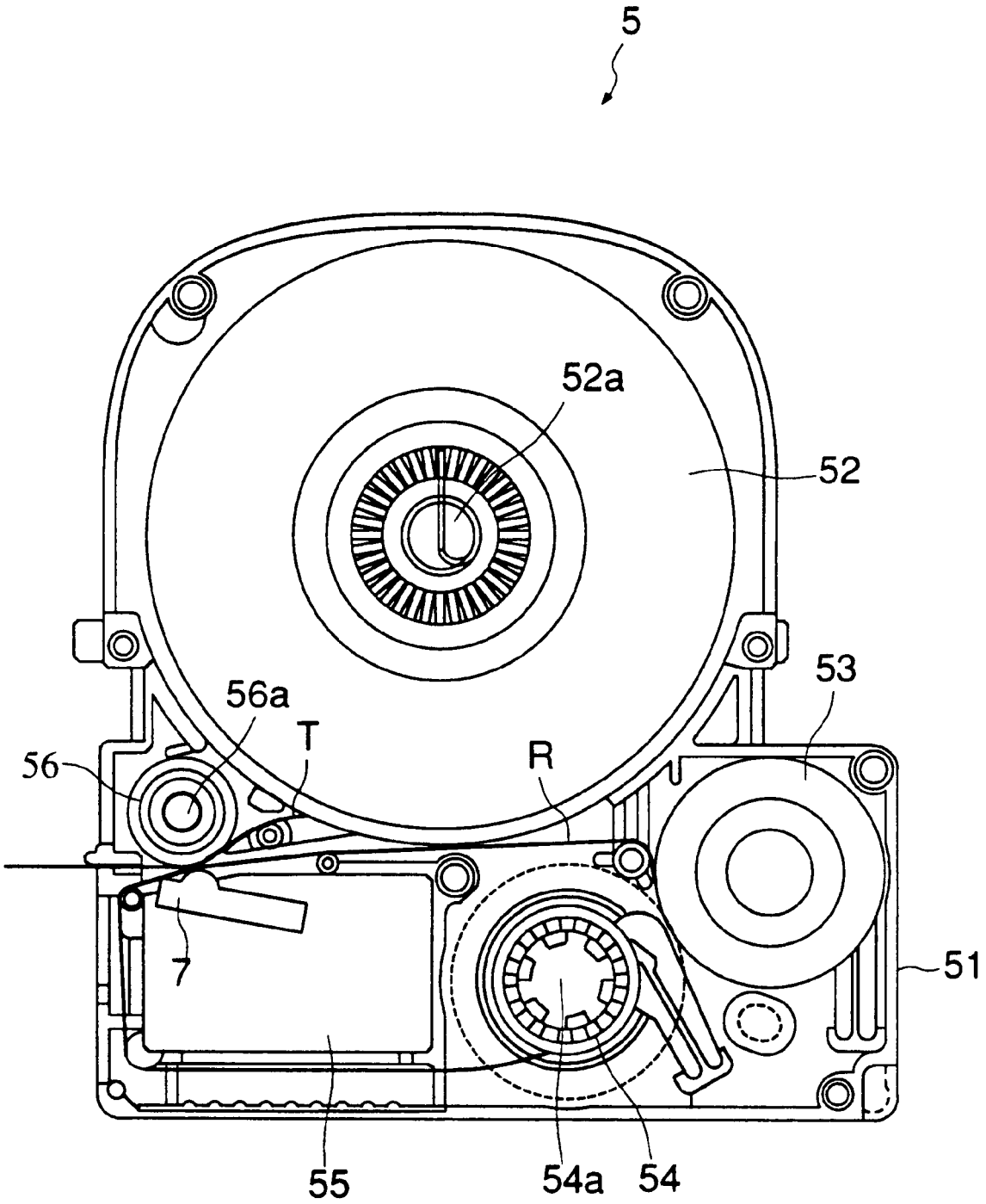
FIG. 3 is a plan view of an internal construction of an example of the tape cartridge for being mounted in the FIG. 1 tape printing apparatus.

Next, the printer block 12 will be described. Referring to FIGS. 2 and 3, the tape cartridge 5 is constructed by a tape T and an ink ribbon R held in a cartridge casing 51. The tape cartridge 5 has a through hole 55 formed at a left-hand side lower portion thereof as viewed in FIG. 2. The through hole 55 is provided for receiving a head unit 61 arranged in the compartment 6 into the tape cartridge 5. Further, a platen roller 56 is accommodated at a location facing a passageway where the tape T and the ink ribbon R are placed one upon the other, for cooperation with the thermal head 7 incorporated in the head unit 61.

On the other hand, in the compartment 6, in a manner corresponding to component parts of the tape cartridge 5, there are provided a platen drive shaft 62 engaged with the platen roller 56 for rotating the same, a take-up drive shaft 63 engaged with a ribbon take-up reel 54 for rotating the same, and a positioning pin 64 such that they extend perpendicularly upward from the bottom of the compartment 6.

When the tape cartridge 5 is loaded in the compartment 6, the through hole 55 of the tape cartridge 5, the center hole 52*a* of a tape reel 52, the center hole 56*a* of the platen roller 56 and the center hole 54*a* of the ribbon take-up reel 54 receive the head unit 61, the positioning pin 64, the platen drive shaft 62 and the take-up drive shaft 63, therein, respectively, which enables the feed of the tape T and the ink ribbon R. Further, when the lid 21 is closed with each of these components in the above operative state, the thermal head 7 is brought into contact with the platen roller 56 in a manner sandwiching the tape T and the ink ribbon R therebetween, whereby the apparatus is ready for a printing operation.

The tape T is unwound from the tape reel 52, while the ink ribbon R is unwound from a ribbon reel 53 and fed or run together with the tape T in a state lying one upon the other, and then they are taken up by the ribbon take-up reel 54. In other words, the platen roller 56 and the ribbon take-up reel 54 rotate in synchronism with each other, whereby the tape T and the ink ribbon R are fed simultaneously, and at the same time the thermal head 7 is driven in synchronism with the feeding of the tapes to thereby carry out printing.

Further, after completion of the printing operation, the platen roller 56 continues to rotate for a predetermined time period (the ribbon take-up reel 54 also continues to rotate in synchronism with rotation of the platen roller 56), whereby the tape T continues to be fed to bring a predetermined cutting position (corresponding to the tape length) on the tape T to the position of the tape cutter 132.

It should be noted that a head surface temperature sensor 144 (see FIG. 7) formed e.g. by a thermistor, is arranged on a surface of the thermal head 7 in an intimately contacting manner, which sends information of the surface temperature of the thermal head detected thereby to the control block 200 described hereinafter.

Figure 4:
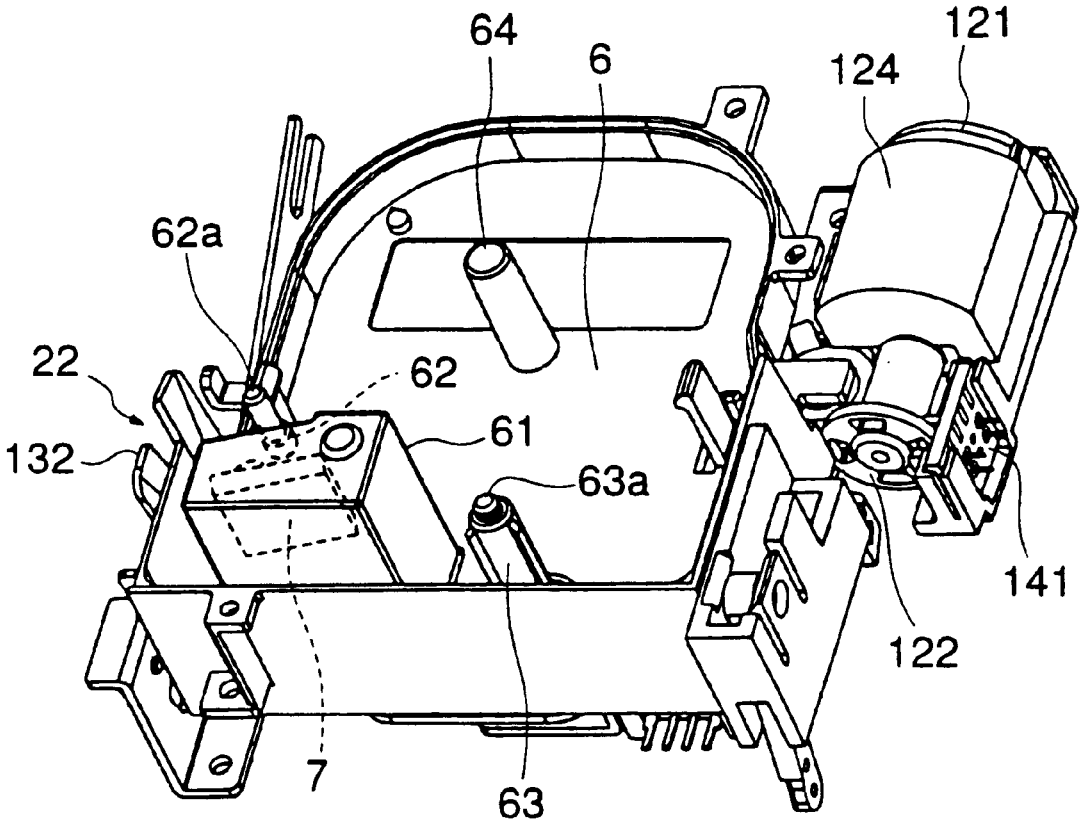
FIG. 4 is a perspective view of a compartment of the tape printing apparatus in which the FIG. 3 tape cartridge is inserted, and component parts in the vicinity thereof.
Figure 5:
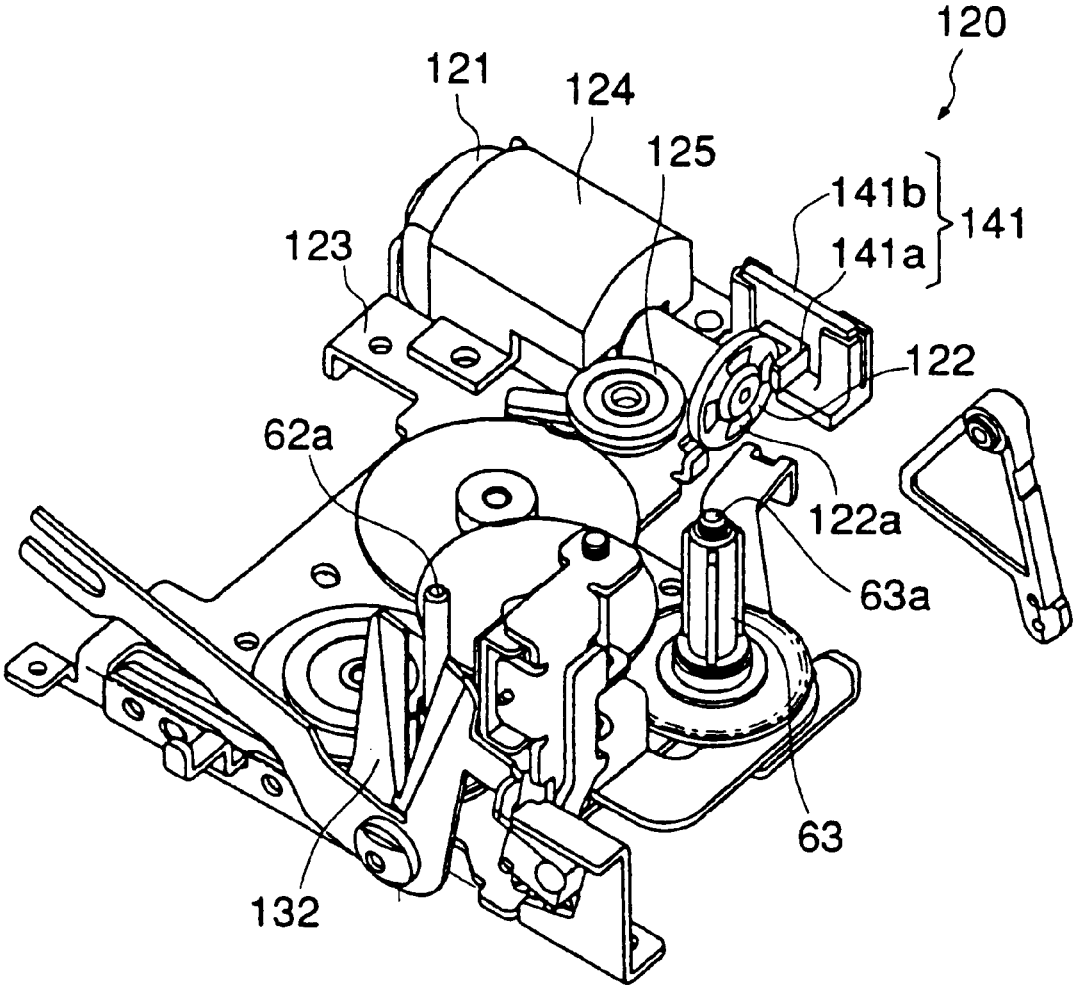
FIG. 5 is a perspective view of components of a driving force-transmitting system of the FIG. 1 tape printing apparatus.
Figure 6:
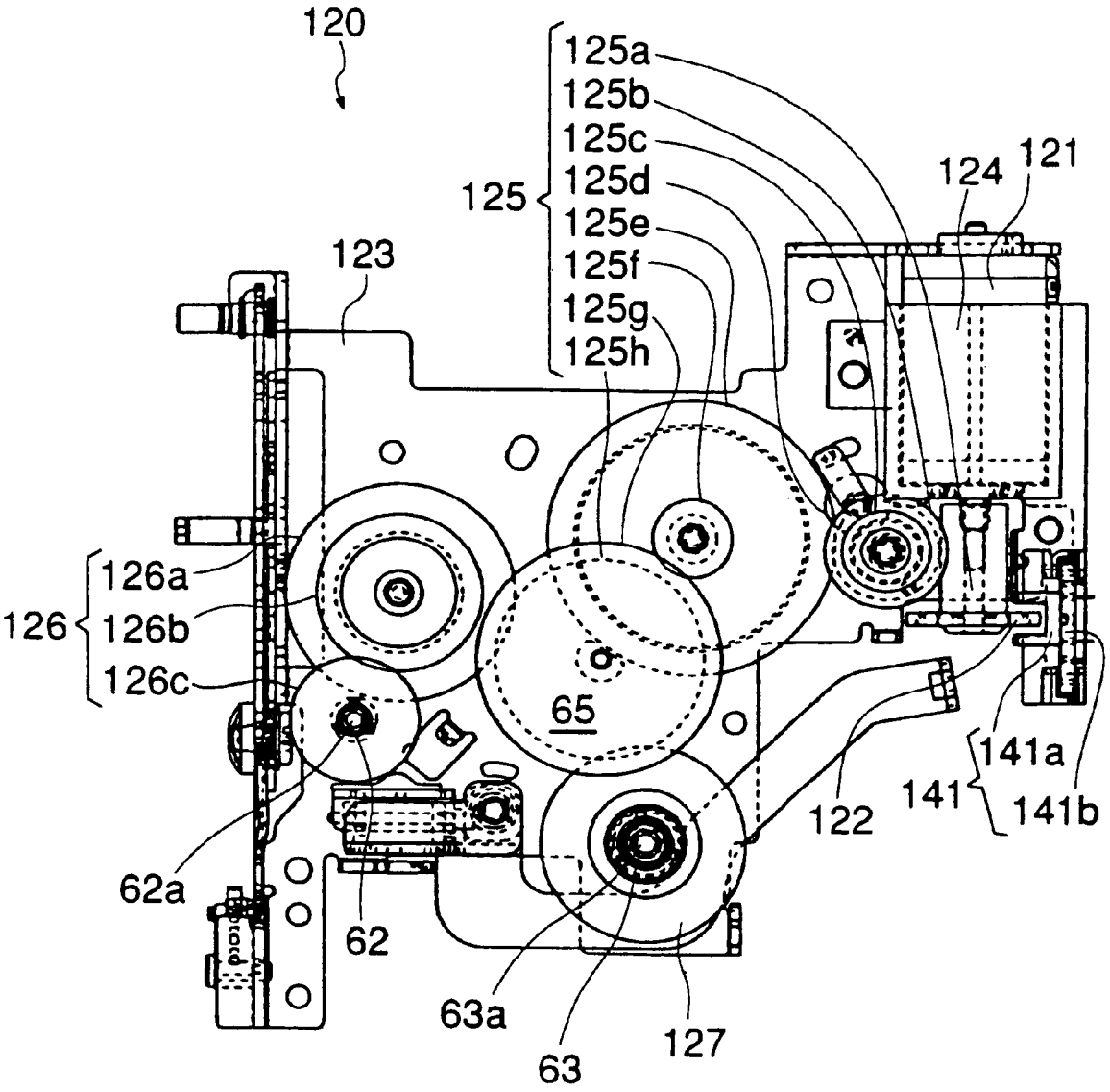
FIG. 6 is a plan view of the driving force-transmitting system of the FIG. 1 tape printing apparatus.

Next, as shown in FIGS. 4, 5 and 6, the tape feeder block 120 is provided so as to rotate the platen drive shaft 62 and the take-up drive shaft 63 by using a DC motor 121 arranged beside the compartment 6 as a driving force (drive) source and is arranged in a space from beside the compartment 6 to the underside thereof.

The tape feeder block 120 includes the DC motor 121, the platen drive shaft 62, the take-up drive shaft 63, a reduction gear train 65 for transmitting part of the driving force of the DC motor 121 to each driving shaft, an encoder 122 for detecting the rotational speed of the DC motor 121, and a chassis 123 for supporting them thereon.

The DC motor 121 is mounted on the chassis 123 by a motor holder 124. The reduction gear train 65 includes a shared gear train 125 on the DC motor side, a platen gear train 126 on the platen drive shaft side, and a take-up drive gear 127 on the take-up drive shaft side.

The torque of the DC motor 121 is transmitted to the shared gear train 125, split at the output end of the shared gear train 125, transmitted to the platen gear train 126 and the take-up drive gear 127, and further transmitted from the platen gear train 126 and the take-up drive gear 127 to the platen drive shaft 62 and the take-up drive shaft 63, respectively.

The shared gear train 125 includes a worm 125*a* fixed to the main shaft of the DC motor 121, a worm wheel 125*b* in mesh with the worm 125*a*, a first gear 125*c* coaxially fixed to the worm wheel 125*b*, a second gear 125*d* in mesh with the first gear 125*c*, a third large gear 125*e* in mesh with the second gear 125*d*, a third small gear 125*f* coaxially fixed to the third large gear 125*e*, a torque-splitting large gear 125*g* in mesh with the third small gear 125*f*, and a torque-splitting small gear 125*h* coaxially fixed to the torque-splitting large gear 125*g*.

The torque of the DC motor 121 is transmitted in the order of the worm 125*a*, the worm wheel 125*b*, the first gear 125*c*, the second gear 125*d*, the third large gear 125*e*, the third small gear 125*f*, the torque-splitting large gear 125*g* and the torque-splitting small gear 125*h*, in a manner such that the rotational speed of the DC motor 121 is progressively reduced, and output to the platen gear train 126 and the take-up drive gear 127.

The platen gear train 126 has an intermediate large gear 126*a* in mesh with the above torque-splitting small gear 125*h*, an intermediate small gear 126*b* coaxially fixed to the intermediate large gear 126*a*, and a platen drive gear 126*c* in mesh with the intermediate small gear 126*b*.

On the top of the platen drive gear 126*c* is arranged the platen drive shaft 62 in a manner extending perpendicularly upward therefrom, and on the top of the take-up drive gear 127 is arranged the take-up drive shaft 63 in the same manner. In addition, reference numeral 62*a* designates a platen roller-side shaft pin connecting the platen drive gear 126*c* and the platen drive shaft 62 for rotation in unison with each other, while reference numeral 63*a* designates a take-up reel-side shaft pin connecting the take-up drive gear 127 and the take-up drive shaft 63 for rotation I unison with each other.

Further, the encoder 122 in the form of a disc is formed with four detection openings 122*a* along a periphery thereof and is coaxially fixed to the end of the worm 125*a* (in the present embodiment, for explanation purposes, only the disc portion except for a rotational speed sensor 141, described hereinafter, is referred to as "the encoder").

The sensor block 14 includes, as shown in FIG. 7, the tape-discriminating sensor 142, the ambient temperature sensor 143 and the head surface temperature sensor 144 as well as the rotational speed sensor 141 for detecting the rotational speed of the DC motor 121. It should be noted that the above sensors can be omitted to suit the actual requirements of the tape-printing apparatus.

The rotational speed sensor 141 is comprised of a photo sensor 141*a* facing the detection openings 122*a* of the encoder 122 and a sensor circuit board 141*b* supporting the photo sensor 141*a* and at the same time carrying out photoelectric conversion of a signal generated by the photo sensor 141*a* (see FIG. 5).

The photo sensor 141*a* has a light-emitting element and a light-receiving element, not shown, arranged in a manner opposed to each other. Light emitted from the light-emitting element passes through the detection openings 122*a* (arranged along the periphery) of the rotating encoder 122 and is received by the light-receiving element to thereby detect the rotational speed (the number of pulses) of the DC motor 121. In other words, the flickering light i.e. light intermittently received from the light-emitting element by the light-receiving element is photoelectrically converted by the sensor circuit board 141*b* and output as a pulse signal (encoder output signal) to the control block 200 described hereinafter.

The drive circuit block 270 includes, as shown in FIG. 7, a display driver 271, a head driver 272 and a motor driver 273.

The display driver 271 drives the display 4 of the operating block 11 in response to control signals delivered from the control block 200, i.e. in accordance with commands carried by the signals. Similarly, the head driver 272 drives the thermal head 7 of the printer block 12 in accordance with commands from the control block 200.

Further, the motor driver 273 has a DC motor driver 273*d* (see FIG. 21) driving the DC motor 121 of the printer block 12 and a cutter motor driver 273*c* driving the cutter motor 131 of the cutter block 13, and similarly, drives each motor in accordance with commands (control signals CN and the like in FIG. 21) from the control block 200.

The operating block 11 includes the keyboard 3 and the display 4. The display 4 has a display screen 41 which is capable of displaying display image data of 96×64 dots on a rectangular display area of approximately 6 cm in the horizontal direction (X direction)×4 cm in the vertical direction (Y direction). The display 4 is used by the user to enter data via the keyboard 3 to form or edit print image data, such as character string image data, view the resulting data, and enter various commands including ones for selection via the keyboard 3.

On the keyboard 3 there are arranged a character key group 31 including an alphabet key group, a symbol key group, a number key group, and a nonstandard character key group for calling nonstandard characters for selection, neither of which is particularly shown, as well as a function key group 32, for designating various operation modes. In a type of the apparatus which is capable of entering the Japanese language, there is also provided a kana key group for entering Japanese hirakana letters and Japanese katakana letters.

The function key group 32 includes a power key, a print key for instructing a printing operation, a selection key for finally determining entry of character data and feeding lines during text entry as well as selecting modes on a selection screen, a color specification key for specifying printing colors and its neutral color (mixed color) of print image data, a color-setting key for setting colors of characters and background colors, and four cursor keys (up arrow key, down arrow key, left arrow key, and right arrow key) for moving the cursor or the display range of print image data on the display screen 41 in respective upward, downward, leftward, and rightward directions.

The function key group 32 also includes a cancel key for canceling instructions, a shift key for use in changing roles of respective keys as well as modifying registered image data, an image key for alternately switching between a text entry screen or a selection screen and a display screen (image screen) for displaying print image data, a proportion-changing (zoom) key for changing a proportion between the size of print image data and the size of display image data displayed on the image screen, and a form key for setting formats of labels to be formed.

Similarly to keyboards of the general type, the above key entries may be made by separate keys exclusively provided therefor or by a smaller number of keys operated in combination with the shift key or the like. Here, for purposes of ease of understanding, the following description will be made assuming that there are provided as many keys as described above.

Further, when the form key is depressed, a form key interrupt is generated as a kind of interrupt handling operation (see FIG. 8), described hereinafter, and a selection screen for setting a format of a label is displayed on the display screen 41 of the display 4.

The selection screen for setting a form is hierarchical and, for instance, options of "Outer frame" for setting outer frames and kinds thereof for labels, "Background pattern" for setting background patterns to be printed on labels or kinds thereof, "Fixed length" for setting a tape length and lengths of margins, etc. are displayed on a top level thereof. In this state, if any of the options is designated by depressing any of the four cursor keys, the designated option is displayed (for selection) in reverse video, and by depressing the selection key, this option is selected whereby the selection screen is switched to a screen for setting details of the selected option.

For instance, when the option "Fixed length" is selected and the selection key is depressed (to select the option), a selection screen for setting a fixed length is displayed.

Then, if an option "Tape length" is selected on the selection screen for setting the fixed length, a screen for setting (selecting) a tape length is displayed, which shows options for designating predetermined lengths, such as "FD-2HD", "Video-VHS", "A4 File", etc. By selecting a desired one e.g. "FD-2HD" from those options, it is possible to set the tape length to a predetermined length (the length of a label for a floppy disk). Furthermore, an option "Desired length" may be selected to switch the selection screen to a screen for setting details of the desired length, and then the tape length can be set by entering a numerical value of the desired tape length.

Further, from the above selection screen for setting the fixed length, it is also possible to select options "Front margin" and "Rear margin" for setting the lengths of marginal areas forward and backward of a printed portion of a tape T, which are included in the length (tape length) of a label. When each of the options is selected, the selection screen is switched to a screen for setting a front margin or a rear margin, so that the lengths of the front and rear margins can be set by inputting desired margin lengths.

Furthermore, print timing data and braking data, described hereinbelow, are determined such that print timing, braking starting-timing, braking loads (resistance values, etc.), etc. can be changed according to the details of the above settings.

Although in the above example, the hierarchical form-setting selection screens displayed by depressing the form key for transition from one screen to another are used, this is not limitative, but there may be provided keys for more directly switching screens, such as a fixed length-setting key for switching to the fixed length-setting selection screen, a tape length-setting key for switching to a tape length-setting screen, a front margin-setting key for switching to a front margin-setting screen, a rear margin-setting key for switching to a rear margin-setting screen, and so forth.

As shown in FIG. 7, from the keyboard 3, various commands described above and data are input to the control block 200.

The control block 200 includes a CPU 210, a ROM 220, a character generator ROM (CG-ROM) 230, a RAM 240, a peripheral control circuit (P-CON) 250, all of which are connected to each other by an internal bus 260.

The ROM 220 has a control program area 221 for storing control programs processed by the CPU 210 as well as a control data area 222 for storing a character size table, a character modification table and control data including printing speed data (or rotational speed data), parameter data, the printing timing data (data of print timing) and the braking data (data of braking), referred to hereinbelow.

Moreover, as described hereinafter, it is also possible to provide various kinds of printing speed data (or rotational speed data), parameter data, print timing data, and braking data, classified according to the ambient temperature, the head surface temperature and the types of tapes.

The CG-ROM 230 stores font data, i.e. data defining characters, symbols, figures and the like, provided for the tape printing apparatus 1. When code data for identifying a character or the like is input thereto, it outputs the corresponding font data.

The RAM 240 is supplied with power by a backup circuit, not shown, such that stored data items can be preserved even when the power is turned off by operating the power key. The RAM 240 includes areas of a register group 241, a text data area 242 for storing text data of letters or the like entered by the user via the keyboard 3, a displayed image data area 243 for storing image data displayed on the display screen 41, a print image data area 244 for storing print image data, a registered image data area 245 for storing registered image data, as well as a print record data area 246 and conversion buffer area 247 including a color conversion buffer. The RAM 240 is used as a work area for carrying out the control process.

The P-CON 250 incorporates a logic circuit for compensating for the functions of the CPU 210 as well as dealing with interface signals for interfacing between the CPU 210 and peripheral circuits. The logic circuit is implemented by a gate array, a custom LSI and the like. For instance, a timer 251, described hereinafter, for measuring elapsed time from a time point of starting the DC motor 121 is incorporated in the P-CON 250 as a function thereof.

Accordingly, the P-CON 250 is connected to the sensors of the sensor block 14 and the keyboard 3, for receiving the above-mentioned signals generated by the sensor block 14 as well as commands and data entered via the keyboard 3, and inputting these to the internal bus 270 as they are or after processing them. Further, the P-CON 250 cooperates with the CPU 210 to output data and control signals input to the internal bus 260 by the CPU 210 or the like, to the driving circuit 270 as they are or after processing them.

The CPU 210 of the control block 200 receives the signals from the sensor block, and the commands and data input via the keyboard 3 via the P-CON 250, according to the control program read from the ROM 220, processes font data from the CG-ROM 230 and various data stored in the RAM 240, and delivers control signals to the driving circuit 270 via the P-CON 250 to thereby carry out position control during printing operations, the display control of the display screen 41, and the printing control that causes the thermal head 7 to carry out printing on the tape T under predetermined printing conditions. In short, the CPU 210 controls the overall operation of the tape printing apparatus 1.

Next, the overall control process carried out by the tape printing apparatus 1 will be described with reference to FIG. 8. As shown in the figure, when the program for carrying out the control process is started e.g. when the power of the tape printing apparatus 1 is turned on, first, at step S1, initialization of the system including restoration of saved control flags is carried out to restore the tape printing apparatus 1 to the state it was in before the power was turned off the last time. Then, the image that was displayed on the display screen 41 before the power was turned off the last time is shown as the initial screen at step S2.

Figure 8:
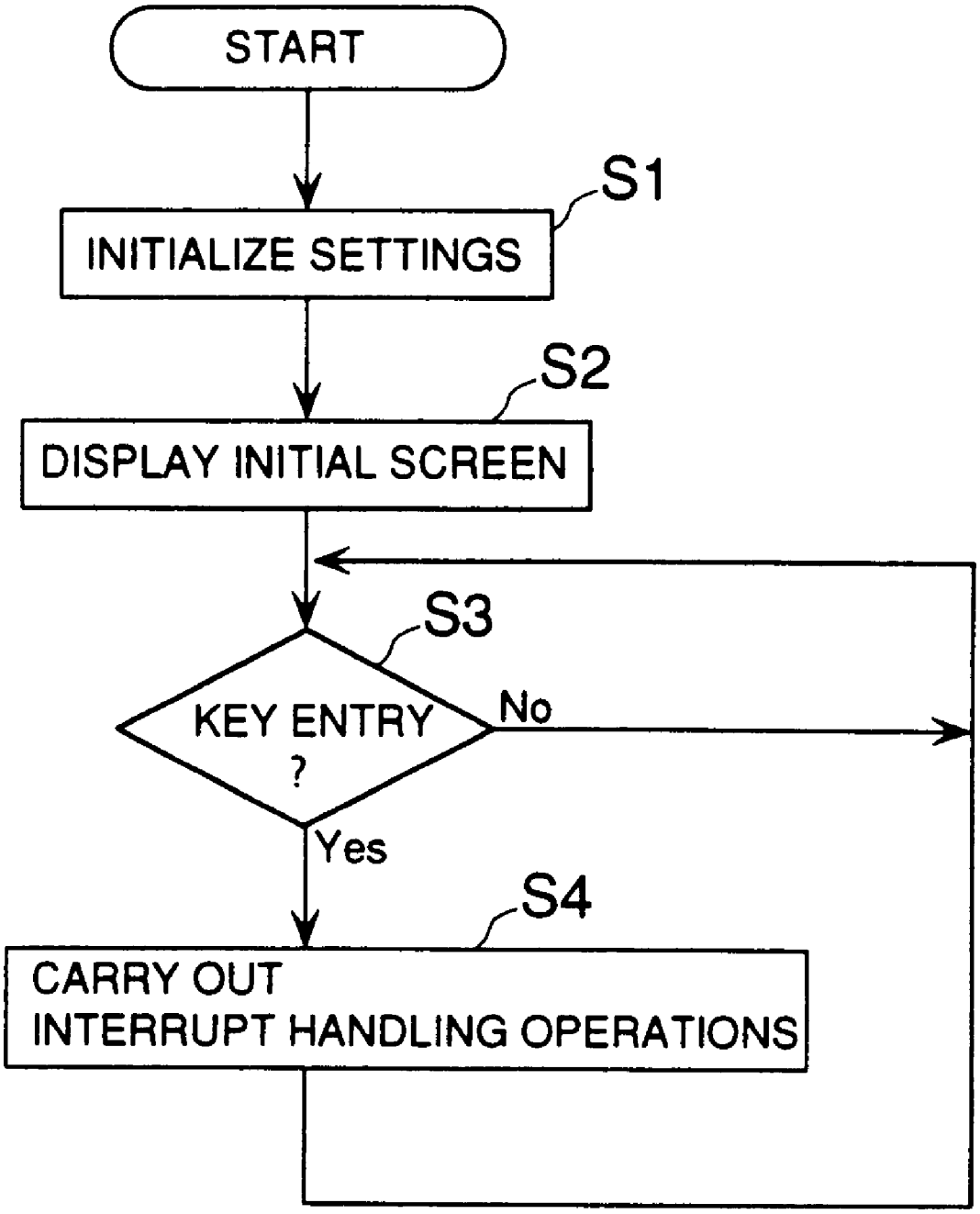
FIG. 8 is a flowchart showing a conceptual representation of an overall control process executed by the FIG. 1 tape printing apparatus.

The following steps in FIG. 8, that is, step S3 for determining whether or not a key entry has been made and step S4 for carrying out an interrupt handling operation are conceptual representations of actual operations. Actually, when the initial screen has been displayed at step S2, the tape printing apparatus 1 enables an interrupt by key entry (keyboard interrupt), and maintains the key entry wait state (No to S3) until a keyboard interrupt is generated. When the keyboard interrupt is generated (Yes to S3), a corresponding interrupt handling routine is executed at step S4, and after the interrupt handling routine is terminated, the key entry wait state is again enabled and maintained (No to S3).

As described above, in the tape printing apparatus 1, main processing operations by the apparatus are carried out by task interrupt handling routines, and hence if print image data for printing is provided or has been prepared, the user can print the image data at a desired time, by depressing the print key to thereby start a printing process, described hereinafter with reference to FIG. 18. Further, operating procedures up to the printing operation can be selectively carried out by the user as he desires.

Now, the principle of heating control, which is carried out for controlling the amount of heat generated by the heating elements of the thermal head 7 in the printing process executed by the tape printing apparatus 1, will be described hereinafter with reference to FIGS. 9 to 15. In other words, description is made of the principles of controlling a strobe pulse STB applied to the thermal head 7 so as to obtain heat in an amount in a predetermined range suitable for printing.

Although in theory, the amount of heat accumulated in the thermal head 7 is varied (reduced) by dissipation of heat as time elapses after the printing was carried out last time, lines of dots of the print image are arranged at fixed space intervals, and hence if the thermal head 7 and a print material (tape T and ink ribbon R in the case of the tape printing apparatus 1) are moved relative to each other at a constant speed for printing, one printing operation for printing lines of dots and the following printing operation for printing next lines of dots (distant from the preceding ones by a number of lines of dots corresponding to the number of rows of heating elements) are carried out at a constant time interval. Therefore, it is possible to maintain the amount of accumulated heat within a predetermined range suitable for printing by applying strobe pulses STB having a predetermined applied voltage and a predetermined pulse-applying time period to the thermal head 7.

Figure 9:
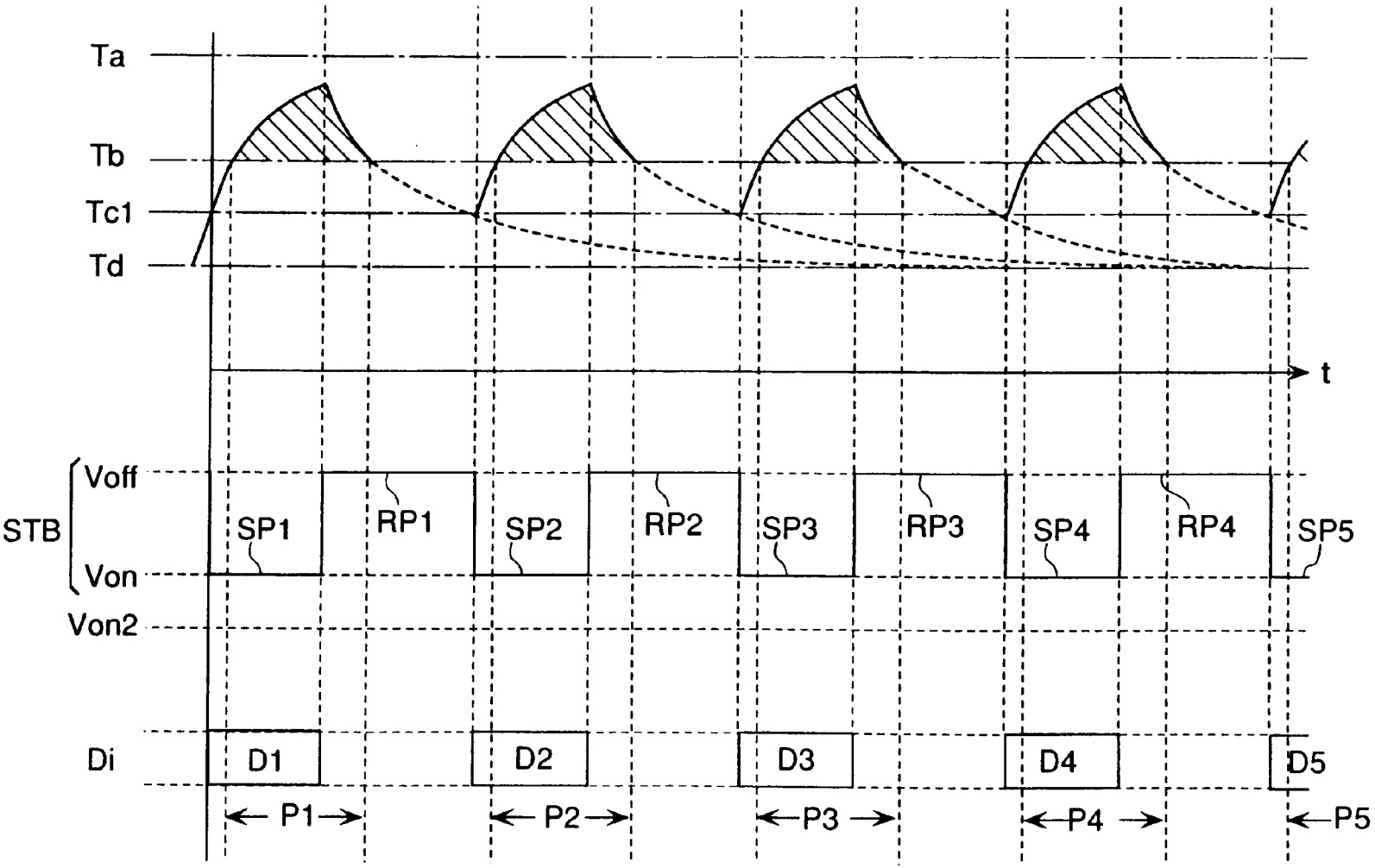
FIG. 9 is a diagram useful in explaining the principle of heating control, which is carried out for controlling an amount of heat generated by heating elements of a thermal head, when a relative speed between the thermal head and print medium is constant.
Figure 10:
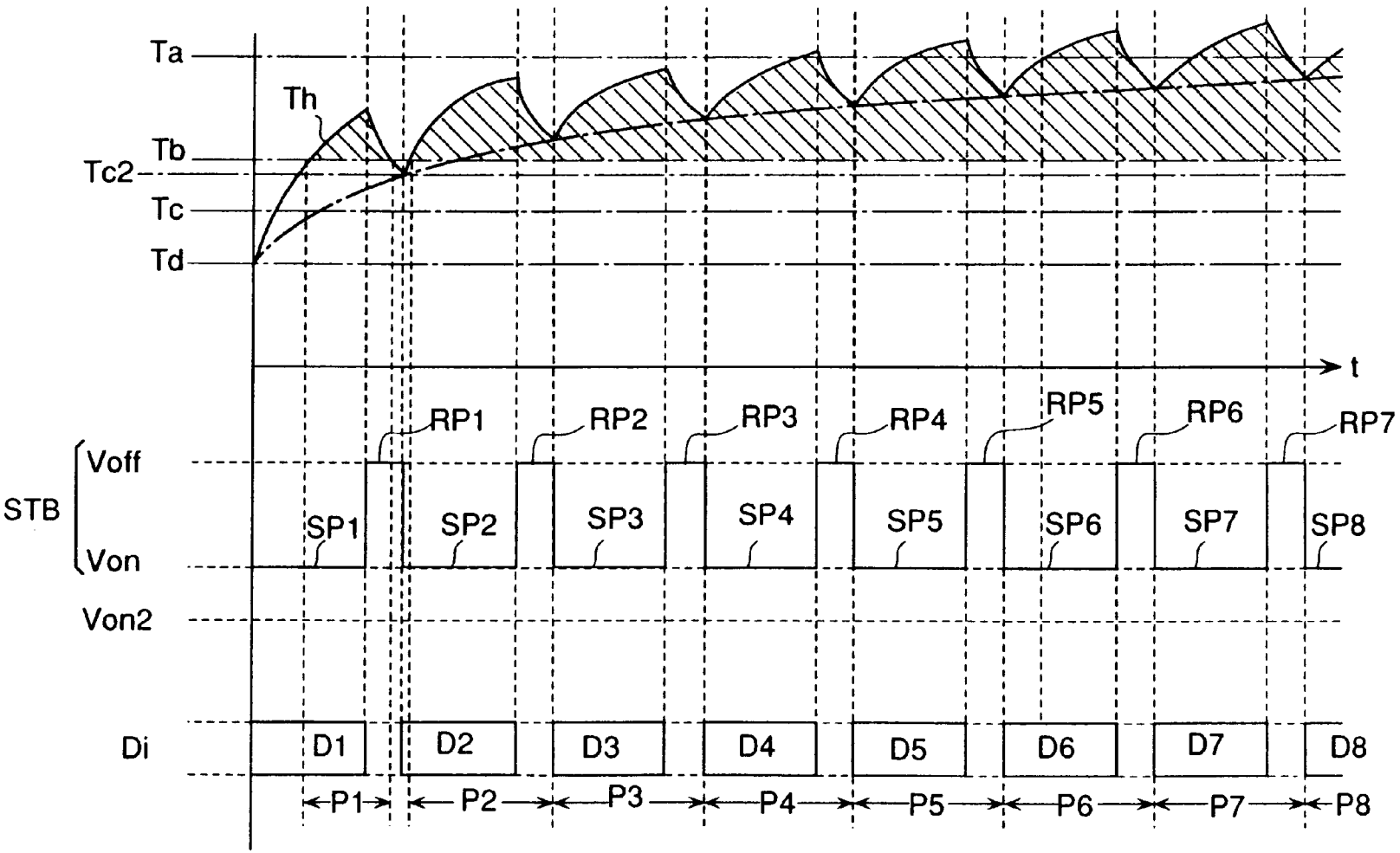
FIG. 10 is a diagram similar to FIG. 9, showing a case where an excess or surplus heat is generated.
Figure 11:
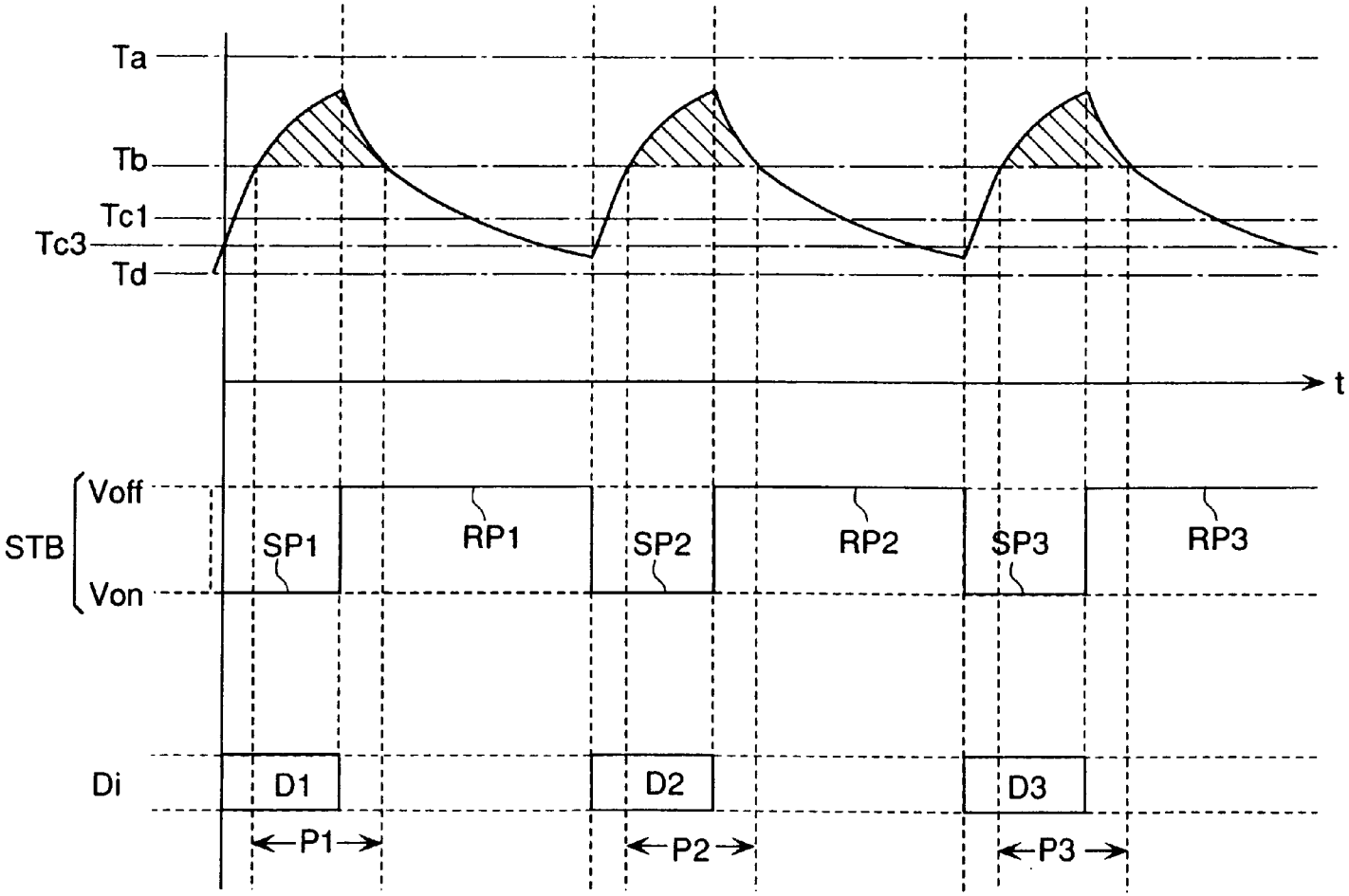
FIG. 11 is a diagram similar to FIG. 9, showing a case where a heat shortage is brought about.

More specifically, when the thermal head 7 and the tape T are moved relative to each other at a predetermined relative speed, for instance, as shown in FIG. 9, a strobe pulse STB having a predetermined applied voltage (applied voltage Von) between an electric potential Voff (set to a ground potential of OV) and an electric potential Von, a predetermined pulse-applying time period SP (=SP1=SP2=SP3= . . . =SPn), and a predetermined idle time period RP (=RP1=RP2=RP3= . . . RPn) is applied to the thermal head 7 based on print data Di (print data Di of a line of dots on an i-th line of dots, wherein i=1, 2, . . . , n), whereby it is possible to cause the thermal head 7 to generate an amount of heat proportional to the product of the applied voltage Von by the pulse-applying time period for heating the same, thereby changing a surface temperature Th of the thermal head 7 with reference to a predetermined temperature Tc1 slightly higher than an ambient temperature Td, as shown in FIG. 9.

In other words, the amount of heat within a predetermined range (corresponding to each hatched area in the figure) suitable for printing can be obtained with the surface temperature Th of the thermal head being in a predetermined range between an upper limit value Ta determined according to a predetermined melting temperature of the substrate tape of the ink ribbon R, below which irreversible thermal deformation of the substrate tape can be prevented, and a lower limit value Tb determined according to a predetermined melting temperature of the ink of the ink ribbon R, above which printing can be properly carried out, whereby it is possible to print a print image of high quality formed without any deformation produced due to an excessively large amount of heat or an excessively small amount thereof during a predetermined printing time period P (=P1=P2=P3= . . . =Pn).

However, even when the relative speed between the thermal head 7 and the tape T is constant, if it assumes a different value, application of the strobe pulse STB having the predetermined applied voltage Von and the predetermined pulse-applying time period SP identical to those shown in FIG. 9 to the thermal head 7 generates an excess or surplus heat when the relative speed is high (see FIG. 10), or a heat shortage is brought about when the same is low (see FIG. 11), thus hindering the suitable amount of accumulated heat from being obtained. This causes deformation of a print image, resulting in the degraded print quality.

Figure 12:
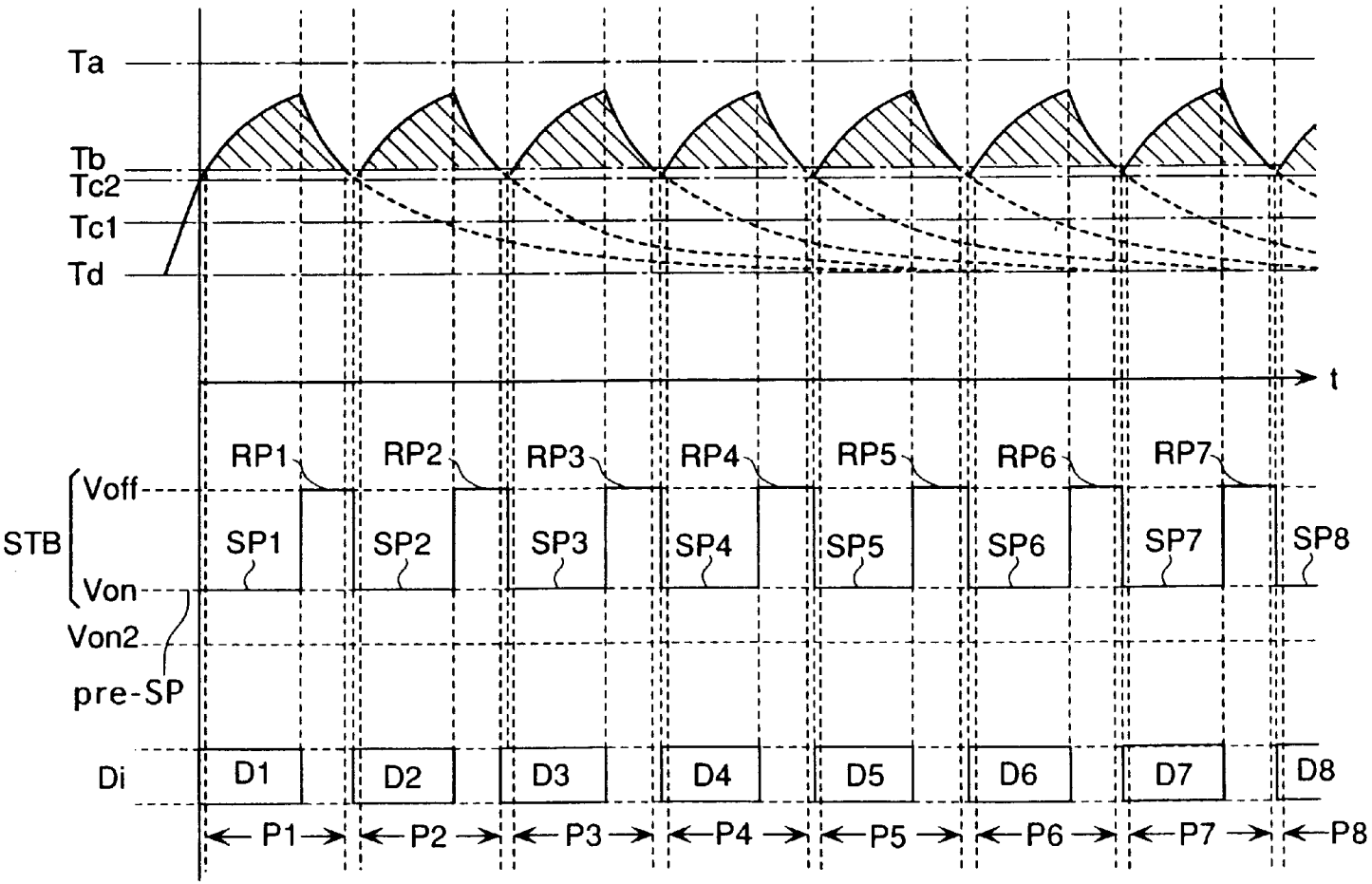
FIG. 12 is a diagram similar to FIG. 9, showing a case where the amount of generated heat and timing of generation of the heat are adjusted by changing a pulse-applying time period, an idle time period and timing of energization of heating elements in a manner corresponding to the FIG. 10 case.
Figure 13:
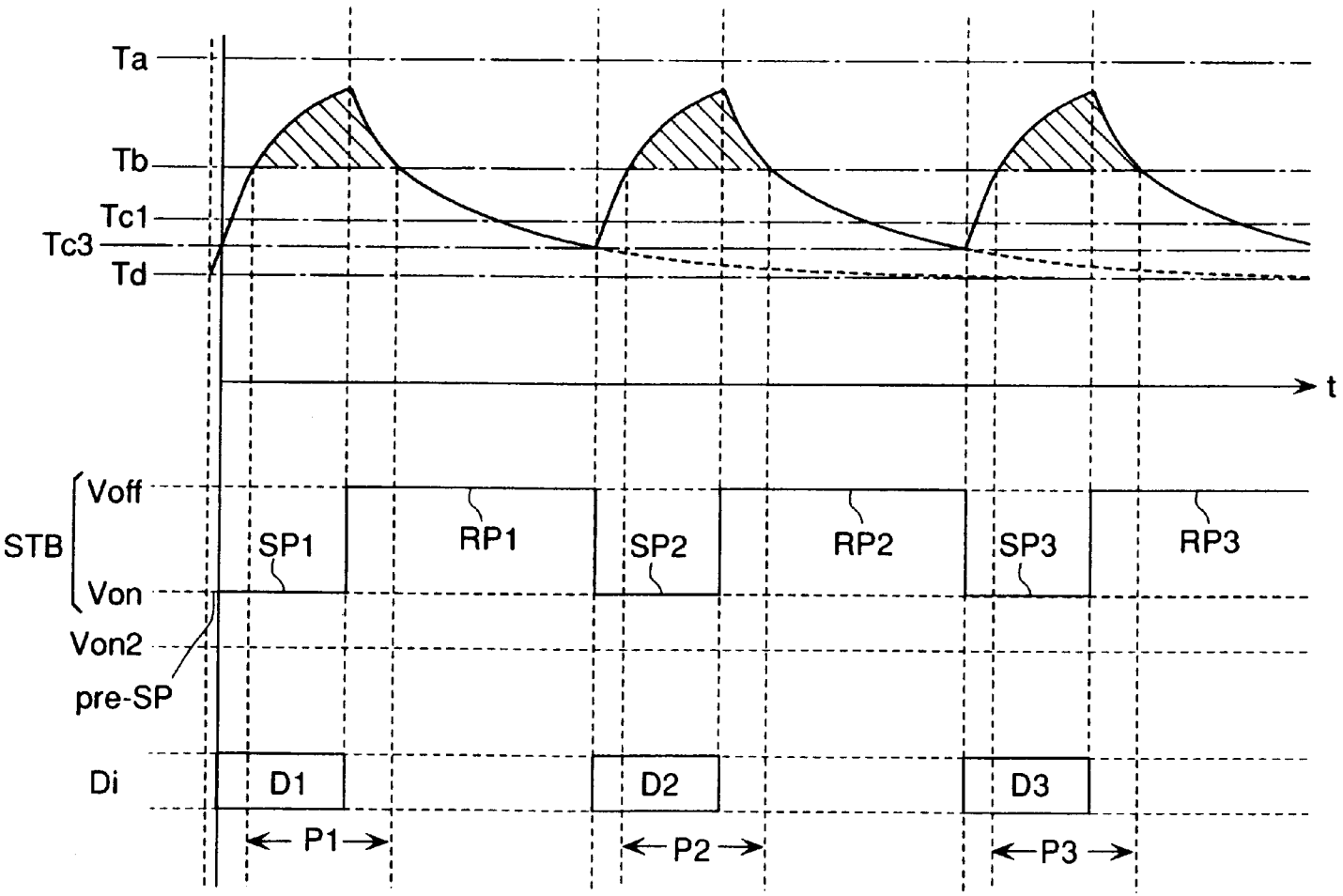
FIG. 13 is a diagram similar to FIG. 9, showing a case where the amount of generated heat and timing of generation of the heat are adjusted by changing a pulse-applying time period, an idle time period and timing of energization of heating elements in a manner corresponding to the FIG. 11 case.

To overcome this problem, in the present embodiment, a preliminary pulse-applying time period pre-SP is provided for a preliminary energization of the print head 7 before carrying out a first actual printing, e.g. as shown in FIGS. 12 and 13, whereby the thermal head 7 is set to a predetermined temperature Tc2 or a predetermined temperature Tc3 slightly higher than an ambient temperature Td, in advance. With reference to the thus set temperature Tc2 or Tc3, a strobe pulse STB having the same predetermined applied voltage Von as that in FIG. 9, a predetermined pulse-applying time period SP (SP=1, etc.) different from that in FIG. 9, and a predetermined idle time period RP (=RP1 and so forth) is applied to the thermal head 7 based on print data Di. As a result, the surface temperature Th of the thermal head 7 is changed as shown in FIGS. 12 and 13 to obtain a suitable amount of heat within each predetermined range with the temperature of the print head 7 being held within the predetermined range, whereby an excess or shortage of heat is prevented to print a high-quality print image free of deformation over a predetermined printing time period P (=P1, etc.).

It should be noted that for a constant but different value of the relative speed between the thermal head 7 and the tape T, it is also possible to suitably control the heating of the thermal head 7 by a method of changing the applied voltage of the strobe pulse STB, besides the above-described methods of changing the pulse-applying time period SP (or the idle time period RP) and changing the timing of start of application of the strobe pulses by using the preliminary pulse-applying time period pre-SP.

Figure 14:
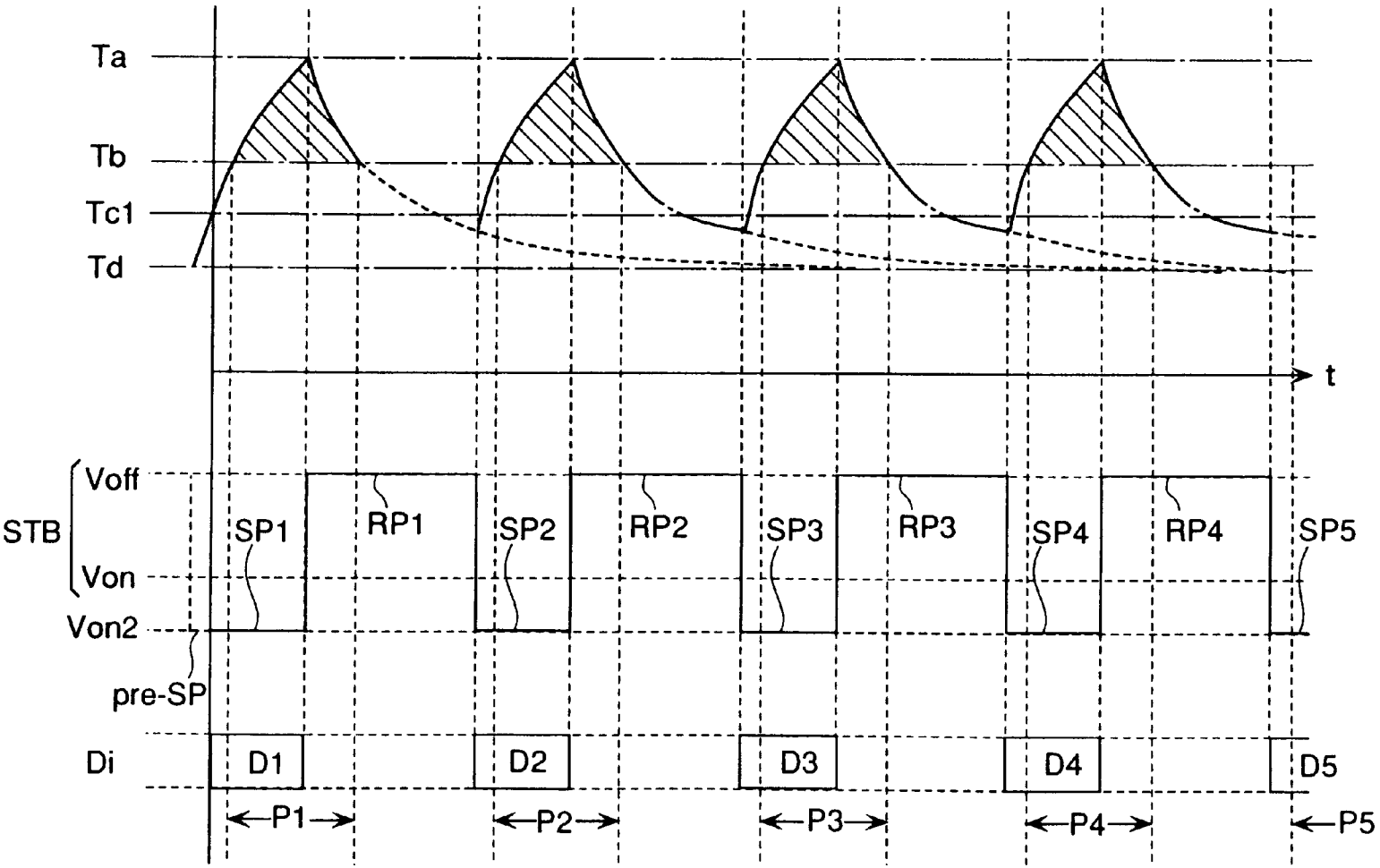
FIG. 14 is a diagram similar to FIG. 9, showing a case where an applied voltage is changed.

For instance, as shown in FIG. 14, the applied voltage Von is changed to an applied voltage Von 2 higher than the same, whereby if the relative speed between the thermal head 7 and the tape T is identical to that in FIG. 9, it is possible to obtain a suitable amount of heat in each of the same pulse-applying time periods SP as those in the FIG. 12.

In the tape printing apparatus 1, as described above, the DC motor 121 is employed as the drive source of relative motion means. Generally, DC motors are relatively inexpensive, while they have no constant speed control circuit, and hence it is difficult to obtain a constant relative speed between the thermal head 7 and the tape T by using them.

Accordingly, in the tape printing apparatus 1 as well, although the above relative speed can be monitored by using the encoder 122 and the rotational speed sensor 141, the relative speed is largely changed due to the increase or decrease of the rotational speed of the DC motor 121, particularly at a time point of starting or stopping the DC motor 121. Hence, an immediately preceding printing operation for printing a line of dots and a next printing operation for printing a next line of dots cannot be carried out at a constant time interval.

Figure 15:
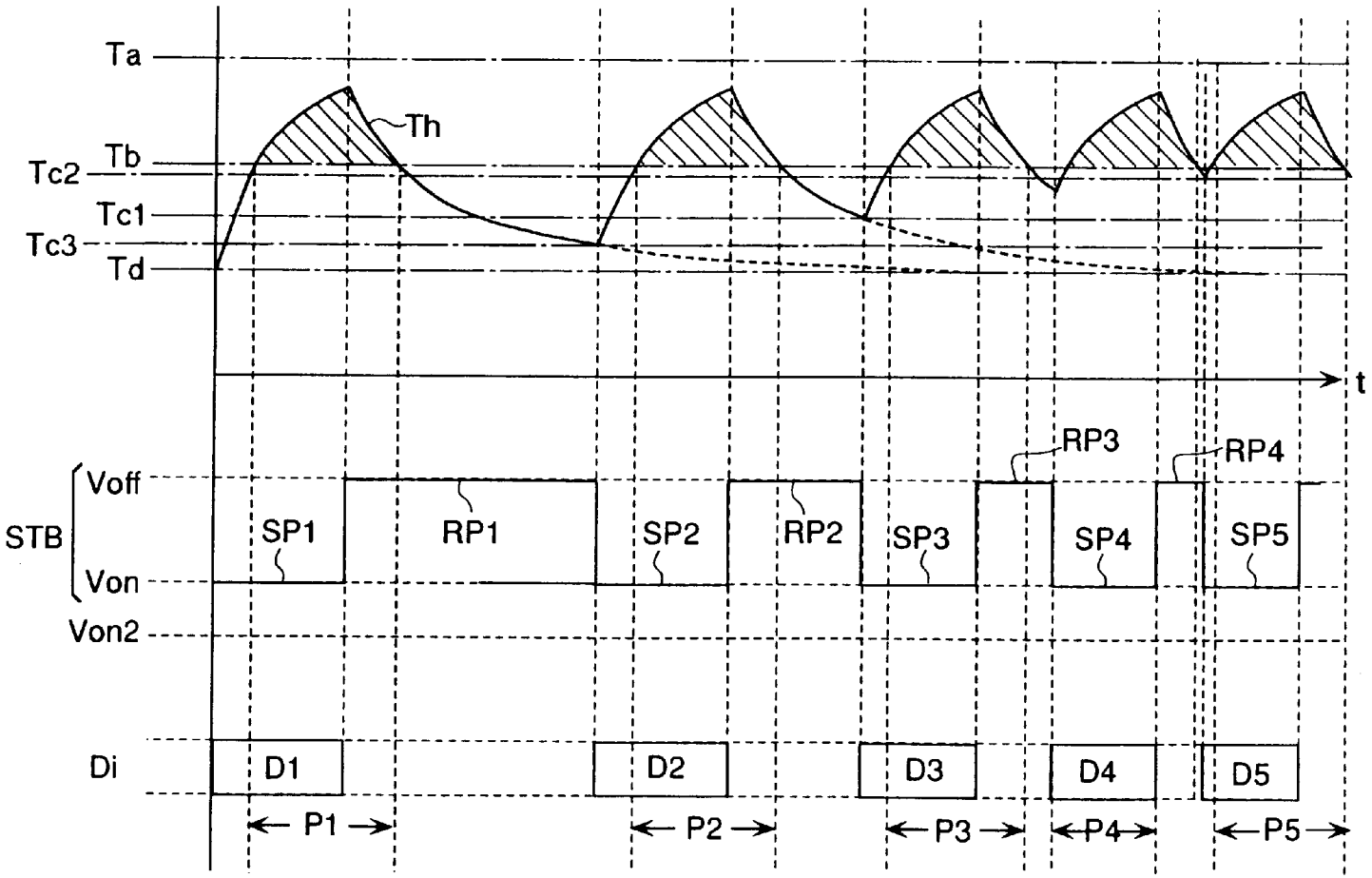
FIG. 15 is a diagram similar to FIG. 9, showing a case where the relative speed is changed.

Therefore, in the tape printing apparatus 1, the heating control is carried out in principle in a manner shown in FIG. 15. That is, as shown in the figure, the thermal head 7 and the tape (print material) T are moved relative to each other at a relative speed set or determined based on the rotational speed of the DC motor 121 as a drive source, and the strobe pulse STB determined based on the print data Di (dot information) of a print image is applied to the thermal head 7 for heating the same such that the surface temperature Th of the thermal head 7 is changed as shown in FIG. 15, while the amount of generated heat and timing of energization of the thermal head 7 is changed according to a variation (changes) in the relative speed between the thermal head and the tape.

That is, the time interval between an immediately preceding printing operation for printing a line of dots and a next printing operation for printing a next line of dots is changed according to a change in the relative speed, and the amount of heat accumulated in the thermal head 7 is varied (reduced) by dissipation of heat as time elapses after the printing was carried out last time, so that the amount of heat generated by the thermal head 7 and timing of energization of the thermal head 7 are caused to change to those dependent on the amount of the dissipated heat, whereby it is possible to obtain an suitable amount of accumulated heat in each predetermined range for printing by heating the thermal head 7 to an extent required for printing of the following line(s) of dots. This makes it possible to preserve the quality of print as well as the reduction of the manufacturing costs of the tape printing apparatus 1 by using the DC motor 121 as a drive source.

Next, depending on the above-described principles, a printing (heating control) process executed by the tape printing apparatus 1 will be described with reference to FIG. 16 et seq.

Figure 16:
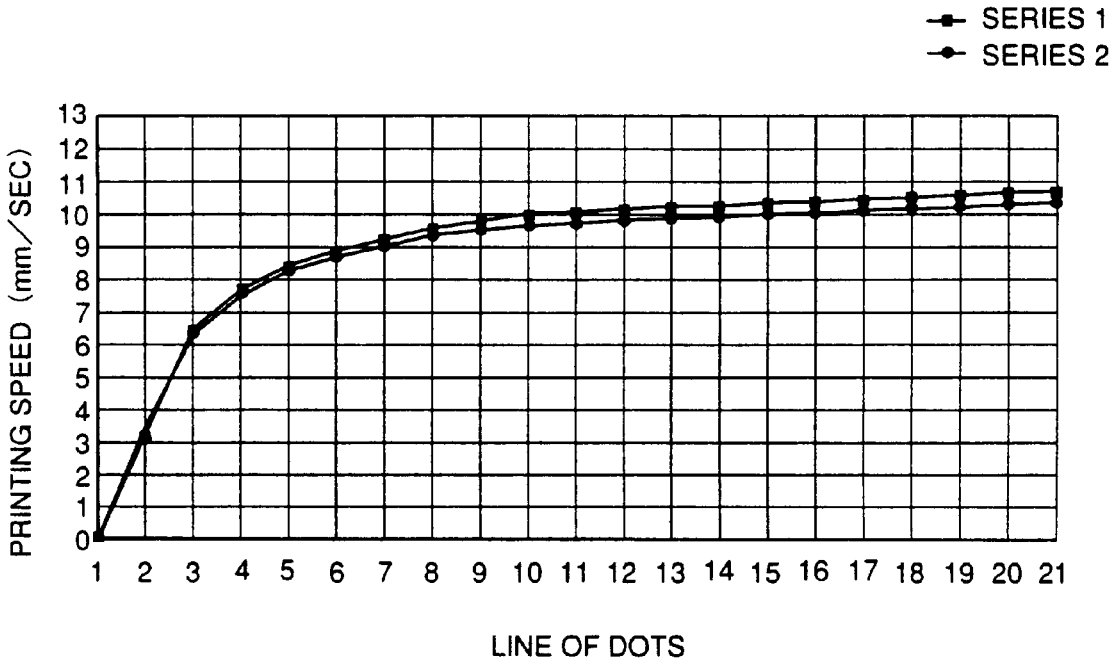
FIG. 16 is a diagram showing an example of printing speed data.

When the DC motor 121 is driven, a printing speed (relative speed) X at a time point of printing print data Di on an i-th (i=1 to 21) line of dots is accelerated immediately after starting the DC motor 121, as shown by FIG. 16 data obtained from actual measurements of printing speeds of the tape printing apparatus 1.

Therefore, in the tape printing apparatus 1, as shown in FIG. 17, the pulse-applying time period SP at the printing speed X is classified into three levels according to the ambient temperature Td measured by the ambient temperature sensor 143. And then, with reference to the pulse-applying time period SP (=predetermined pulse-applying time period Tstd 4 set e.g. for the ambient temperature Td=22.5° C.) to be used at a time point at which the printing speed X has reached a predetermined speed (Speed 3: $9 \leqq X$ [mm/sec]), the pulse-applying time period SP at a speed (Speed 1: $0 \leqq X < 8$ [mm/sec]) assumed at the start of acceleration is set to a value of the reference pulse-applying time period multiplied by 1.5, while the pulse-applying time period SP at an intermediate speed (Speed 2: $8 \leqq X < 9$ [mm/sec]) is set to a value of the reference pulse-applying time period multiplied by 1.05.

It should be noted that the measured data described above with reference to FIG. 16 is stored as printing speed data in the control data area 222 in the ROM 220, and the FIG. 17 data of the pulse-applying time periods is stored as parameter data of the strobe pulse STB in the same.

Further, in the control data area 222 is also stored print timing data, which indicates timing (print timing) of printing each print data Di on an i-th line of dots calculated back from the printing speed data, in terms of a time period (value of the timer 251) elapsed from the start of the DC motor 121.

Next, the printing process carried out based on the above data is described with reference to FIG. 18. As described hereinabove, when the user depresses the print key at a desired time point, a task interrupt responsive to input via the print key is generated to start the printing process shown in FIG. 18.

As shown in the figure, when the present process is started, first, initialization of the system is carried out at step S11. More specifically, the value of the ambient temperature Td is obtained from the ambient temperature sensor 143, and the number of lines of dots from which a printing-terminating process is to be started, the total number of lines of dots of a print image, and the number of counts of lines of dots are set to variables M (in the following description, it is assumed that M=0 is set as an initial value), n (similarly, n=128 is set as an initial value), and i (similarly, i=1) respectively. Then, the timer 251 is reset at step S11.

When the initialization is terminated at step S11, the DC motor 121 and the timer 251 are activated at step S12, and then at step S13, print data Di (D1) of the i-th (i=1 in the present process) line of dots is transmitted to the head driver 272.

After completing the transmission of the print data Di (S13), next, the value of the timer 251 is obtained at step S14 and the print timing (Yes to S15) for printing the print data Di of the i-th line of dots is awaited (No to S15). When the print timing (Yes to S15) has reached, the parameters of the strobe pulses STB are set at step S16.

At this time point, as described hereinbefore with reference to FIG. 17, the pulse-applying time period SP is defined as parameter data, and hence according to the ambient temperature Td and the printing speed X, a corresponding pulse-applying time period is set at step S16.

When the setting of the parameter (pulse-applying time period SP) is terminated at step S16, the strobe pulse STB is applied to the thermal head 7 based on the parameter (pulse-applying time period SP) and the print data Di, to thereby print the print data Di at step S17. Then, after the variable i is incremented (i=i+1) and the variable n is decremented (n=n−1) at step S18, it is determined at step S19 whether or not an M-th line of dots prior to completion of the printing process which is indicative of a line where the printing-terminating process should be started is reached.

Now, since the variable M=0, the variable n=127, the variable i=2, and M<n hold (No to S19), next, print data Di (D2) of the i-th (i=2) line of dots is transmitted to the head driver 272 at step S13. Thereafter, by repeating the same procedure at steps S14 to S18, it is determined again at step S19 whether or not the M-th line of dots prior to completion of the printing process is reached.

At this time point, the variable M=0, the variable n=126, the variable i=2, and M<n hold (No to S19), and hence thereafter, similarly to the above, the loop of the steps S13 to S19 is repeatedly carried out to process print data Di (D3 to D128) on the i-th (i=3 to 128) line of dots until a time point of completing printing of print data D128 (=Di) on the 128-th (=i-th) line of dots, at which the variable M=0, the variable n=0, the variable i=129, and M≧n hold (Yes to S19), followed by carrying out the printing-terminating process at step S20.

Here, if the printing-terminating process is carried out only to turn off the DC motor 121, the DC motor 121 rotates by inertia for a while, and then stops (step S20) to terminate the whole printing process at step S21.

As described above, in the tape printing apparatus 1, the amount of heat generated by the thermal head 7 and timing of energization of the same are changed according to the change (variation) in the relative speed caused by the acceleration of the DC motor 121 particularly when it is started. Hence, it is possible to obtain a suitable amount of accumulated heat in each predetermined range for printing by heating the thermal head 7 to an extent required for printing a next line of dots, which makes it possible to preserve the quality of print and at the same time reduce the manufacturing costs of the tape printing apparatus 1 through the use of the DC motor 121 as a drive source.

Although in the above example, to change the amount of heat generated by the thermal head 7 and timing of generation of the heat, both of the pulse-applying time period SP and the idle time period RP are changed, this is not limitative, but only one of the pulse-applying time period SP and the idle time period RP may be changed according to a temporary change in the relative speed due to slippage of the tape T, for instance, or change in the ambient temperature Td.

In such a case, if the pulse-applying time period SP of the strobe pulse STB is changed without changing the idle time period RP thereof, it is possible to change the amount of heat generated by the thermal head 7 as well as the timing of energization of the thermal head 7 for printing a next line of dots. Inversely, if the pulse-applying time period is not changed but the idle time period thereafter is changed, the timing of the energization for printing a next line of dots can be changed.

Further, when the pulse-applying time period SP and the idle time period RP thereafter are to be changed, if the pulse-applying time period SP is increased or decreased and the idle time period RP is decreased or increased in a manner corresponding to the increased or decreased amount of the pulse-applying time period SP, only the amount of generated heat can be changed without changing the timing of the energization. Further, if the pulse-applying time period SP and the idle time period RP thereafter are changed as desired, a desired amount of heat can be generated at a desired timing, so that it is possible to obtain a suitable amount of accumulated heat within a predetermined range, at an appropriate timing responsive to a change in the relative speed.

Further, as described above with reference to FIG. 14, the amount of heat generated per unit time period can be changed by changing the applied voltage Von. Therefore, if this heat control method is employed in combination with the method of changing the pulse-applying time period SP and the idle time period RP, it is possible to increase the freedom of changing (setting) of the pulse-applying time period SP and the idle time period RP.

Although in the examples described above with reference to FIGS. 17 and 18, the ambient temperature Td of the thermal head 7 is detected, and based on the detected ambient temperature and the printing speed X, the pulse-applying time period SP and the idle time period RP are changed to thereby adjust the amount of generated heat and the timing of generation of heat, this not limitative, but, for instance, when the tape printing apparatus 1 is used in an environment having a constant ambient temperature, detection of the ambient temperature Td can be omitted, and the ambient temperature sensor 143 can also be omitted (eliminated).

Further, the tape printing apparatus 1 also includes the head surface temperature sensor 144, as described hereinabove, and hence if the head surface temperature Th can be detected instead of the ambient temperature Td or in addition to the same, it becomes possible to carry out the heat control with higher accuracy. Of course, detection of the head surface temperature Th and the head surface temperature sensor 144 for use in the detection may be omitted if permitted by practical or environmental conditions or the like.

Furthermore, as described above, the tape printing apparatus 1 also has the tape-discriminating sensor 142, so that if load torque is changed according to the type of a tape loaded in the apparatus to adversely affect the printing speed or the like, data of the printing speed and parameter data may be configured to be capable of reflecting the type of the tape. Also, if a change in the voltage is detected, the data may be configured to be capable of reflecting the change in the voltage. Of course, the detection of the type of a tape or the change in the voltage, and the tape-discriminating sensor 142 and the like for use in the detection can be omitted from or added to the apparatus, so as to suit the practical conditions under which the apparatus is used.

Figure 18:
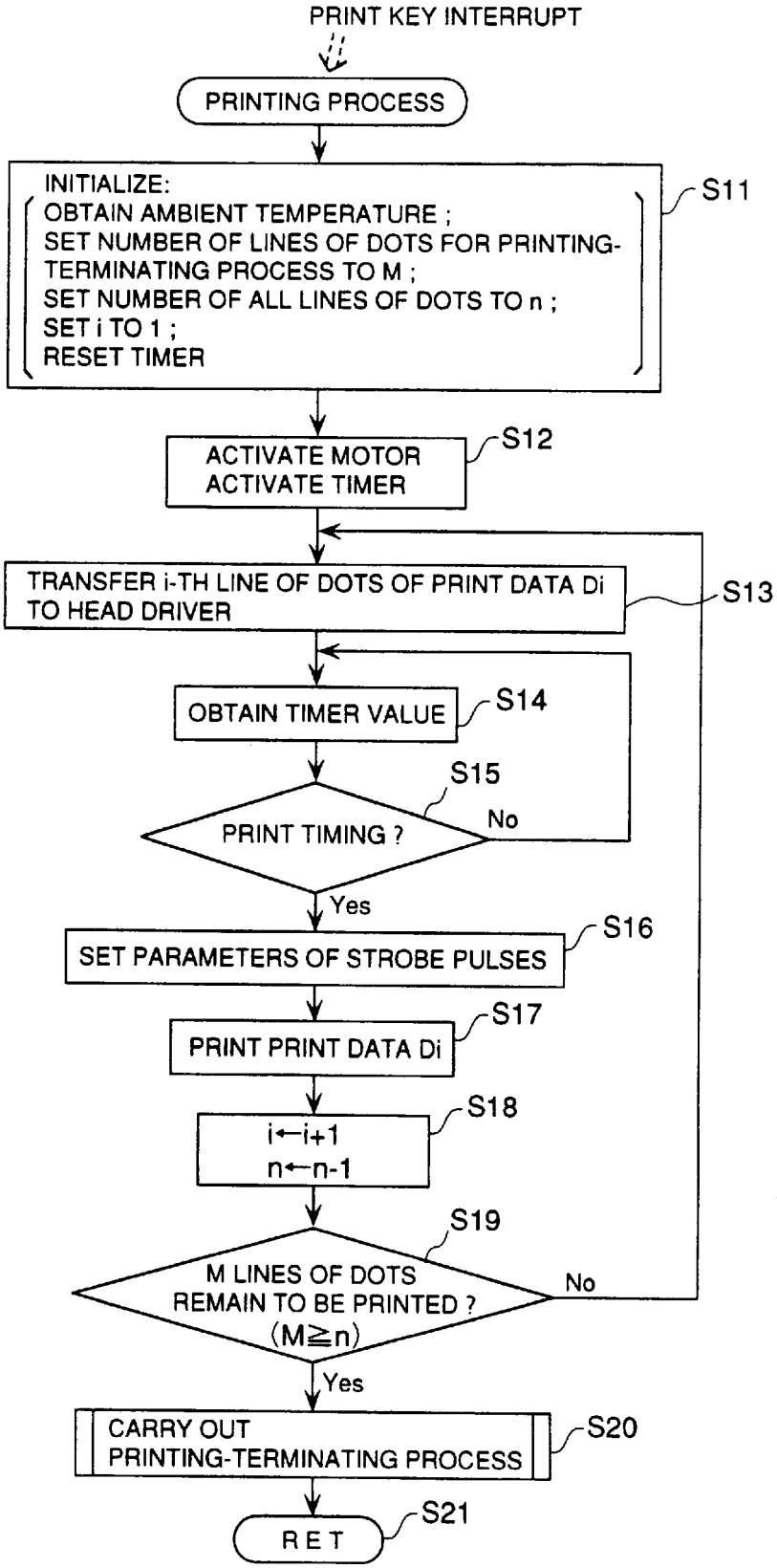
FIG. 18 is a flowchart showing a printing process carried by the tape printing apparatus.

Still further, in the FIG. 18 printing-terminating process (S20), even after the power is turned off, the DC motor 121 continues to rotate for awhile by inertia. Hence, the last M line(s) of dots may be printed by using this rotating force, i.e. during rotation of the DC motor 121 by inertia. Further, to carry out this printing process without depending on the inertia force alone, the tape printing apparatus 1 may be configured such that the load on the DC motor 121 is changed, as described hereinafter.

In these cases, data of changes (variation) in the relative speed caused by deceleration during stoppage of the DC motor 121 may be provided as data of printing speed, similarly to the data of changes (variation) in the relative speed caused by acceleration of the DC motor 121 upon starting of the same. For instance, by setting the variable M described above with reference to FIG. 18 to 2 (variable M=2), the same process as realized by the above-mentioned loop (S13 to S19) may be carried out as the printing-terminating process (S20), when the variable n becomes equal to the variable M(=2) (Yes to S19), whereby the last two (=M) lines of dots can be printed (see FIG. 19C).

Figure 19A:
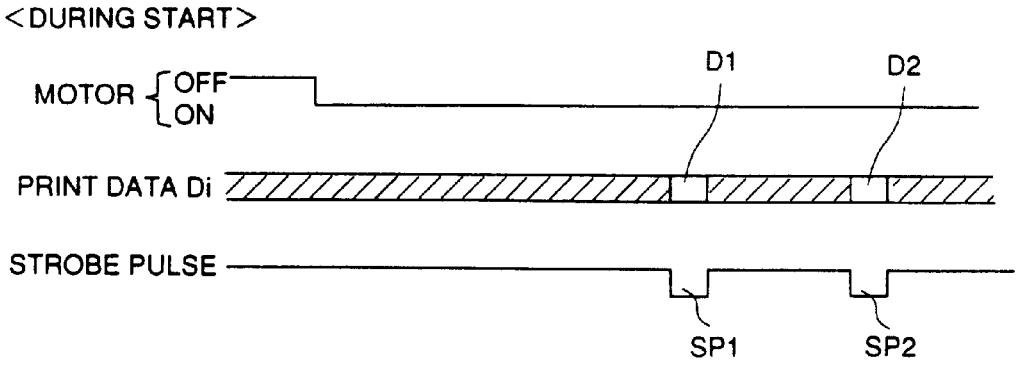
FIGS. 19A to 19C are schematic timing charts showing examples of timing of major events in printing operations.
Figure 19B:
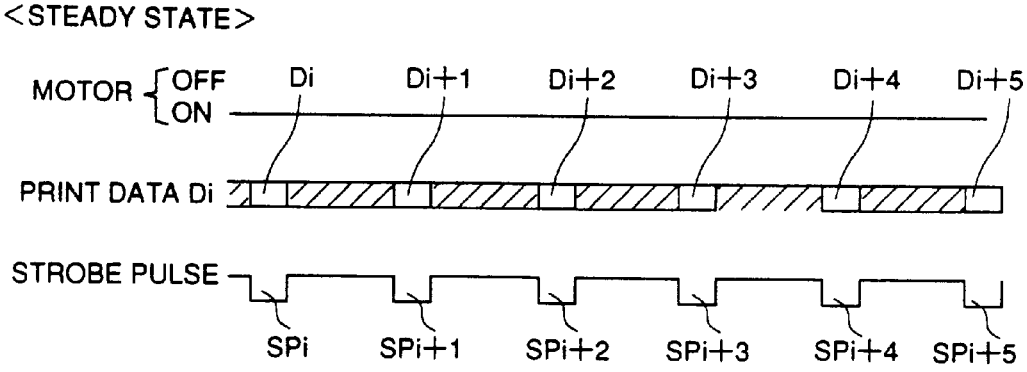
Figure 19C:
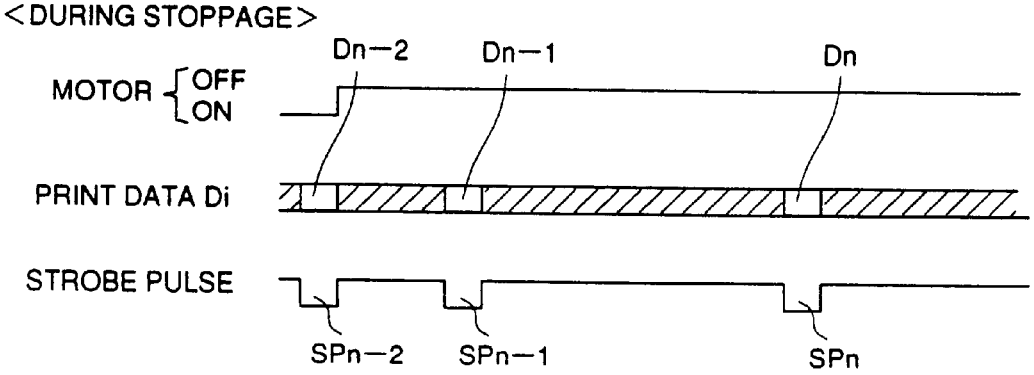

Further, a step similar to the above loop determining step S19 may be inserted whereby the above loop (S13 to S19)

may be executed on three different times: when the DC motor 121 is started, when it is in a steady state, and when it is stopped (see FIGS. 19A and 19B). Of course, data for the above three times may be provided as series of printing speed data so as to allow the same to be made use of in a single loop process.

Further, although in the above example, printing speed data is stored which was empirically obtained when the DC motor 121 as a drive source was started and thereafter, whereby the amount of generated heat and timing of generation of the heat are changed based on the printing speed data, this is not limitative, but data of rotational speeds of the DC motor 121, which was empirically obtained when the same was started and thereafter, may be stored instead of the printing speed data, to thereby calculate the printing speed X from the data of the rotational speeds.

Figure 20A:
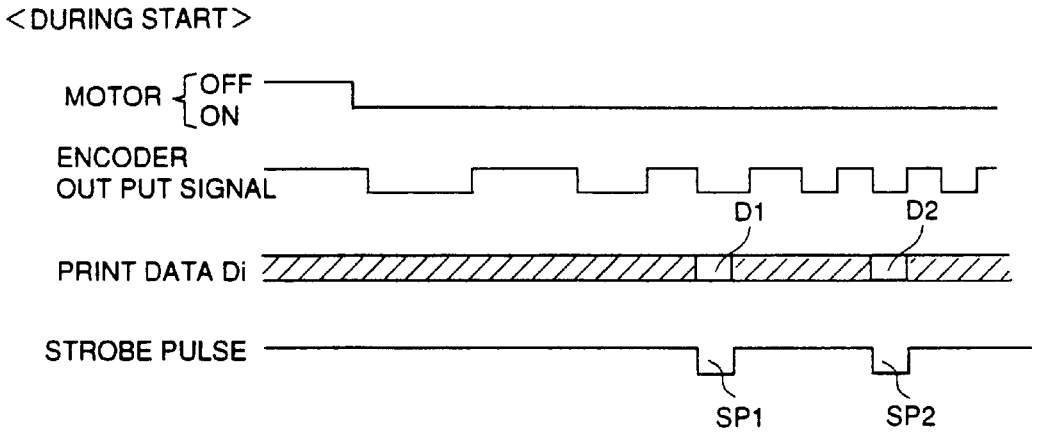
FIGS. 20A to 20C are diagrams similar to FIGS. 19A to 19C, showing other examples of the timing of major events of the printing operations.
Figure 20B:
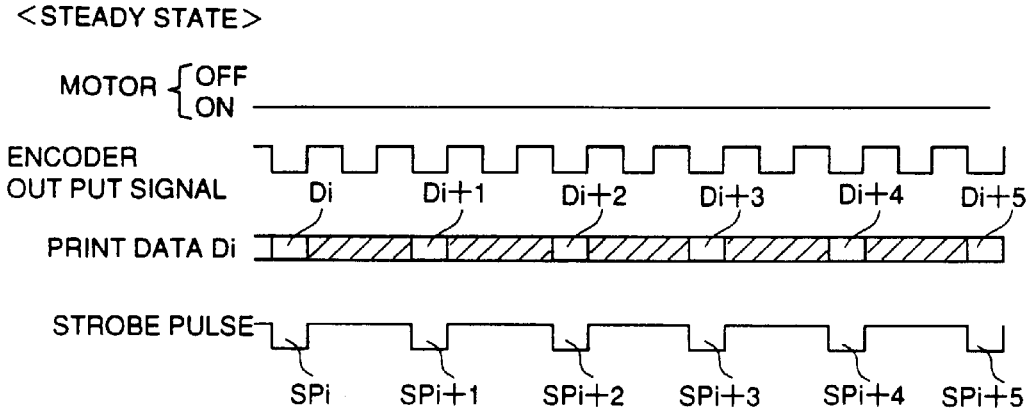
Figure 20C:
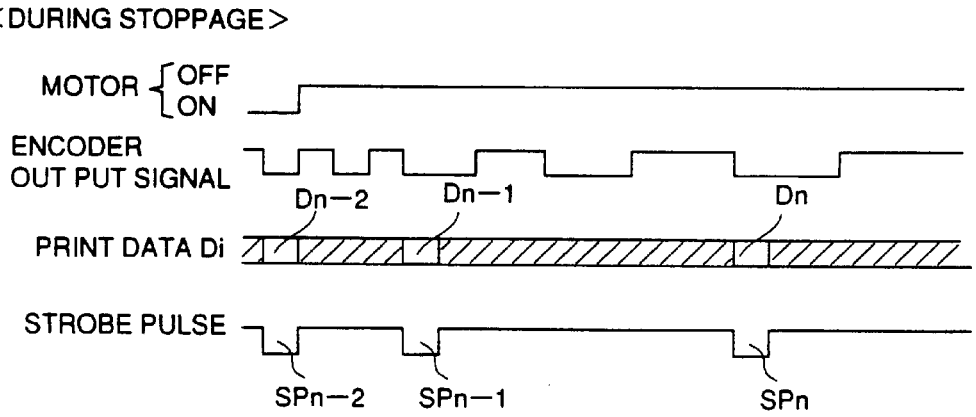

Still further, the tape printing apparatus 1 includes, as described above, the encoder 122 and the rotational speed sensor 141, and hence instead of using the printing speed data or the rotational speed data, it is possible to directly detect an actual rotational speed of the DC motor 121 and calculate the printing speed based on the detected rotational speed (see FIGS. 20A to 20C: encoder output signal in each figure is a signal (pulse signal mentioned hereinabove) indicative of the rotational speed, sensed by the encoder 122 and the rotational speed sensor 141). Of course, this signal can be substituted by the printing speed data and the rotational speed data, so that they can be omitted or added to suit the practical conditions under which the tape printing apparatus 1 is used.

Furthermore, although in the above example, a line of dots of a print image is printed at a time (simultaneously), this is not limitative, but each line may be printed a plurality of divisional times such that one print timing is slightly shifted from another, as is conventionally employed. For instance, when each line of dots of a print image form of 128 dots (e.g. in the case of the print image of 128×128 dots), a line of dots (128 dots) can be printed in two steps by printing 64 dots at each step.

In these cases, the above loop may be multiplexed to change the number of dots printed by one strobe pulse-applying operation, whereby the amount of generated heat and timing of generation of the heat can be changed, so that simply by multiplication of the loop, the above split printing carried out divisional times can be carried out basically by the same loop as described above.

Further, when a print image is printed based on actual print data Di, there are produced dots to be printed and dots not to be printed on an identical line of dots. If dots on the same i-th line are printed, the temperature (particularly the surface temperature of the thermal head 7) around the energized heating elements is also raised in accordance with the printing operation, and hence normally it is only required to collectively control the heating elements. However, it is also possible to employ a method of storing print record data (in the print record data area 246) which records e.g. a time of an immediately preceding printing operation on a dot-by-dot basis (heating element by heating element) to thereby control each heating element. This variation enables more delicate heating control (with higher accuracy).

In the tape printing apparatus 1, the DC motor 121 is used as a drive source for relative motioning means and hence it is difficult to obtain a constant relative speed. Therefore, as described above, the amount of generated heat and timing of generation of the heat are changed according to changes in the relative speed, whereby a suitable amount of accumulated heat in each predetermined range for printing is obtained by heating the thermal head 7 to an extent required for printing a next line of dots, to preserve the quality of print.

Further, as described above, if a load torque is changed according to the type of tape mounted in the apparatus to adversely affect the printing speed or the like, the printing speed data (or data of rotational speeds of the motor), parameter data, or data of print timing data may be configured to reflect the type of tape detected by the tape-discriminating sensor 142. Also, if a change in the voltage is detected, the data may be configured to be capable of reflecting the change in the voltage. Further, by monitoring the printing speed by using the encoder 122 and the rotational speed sensor 141, the results of the detection may be utilized, in carrying out the printing process.

Therefore, a first problem caused by the use of the DC motor 121 as the drive source for the tape printing apparatus 1, that is, a problem of the degraded quality of print caused by changes in the relative speed occurring when the DC motor 121 is started and stopped is solved by carrying out the printing process (particularly heating control) described above with reference to FIG. 18, etc.

However, as described hereinbefore as to the prior art, the incapability of the constant speed control causes another problem in fixed length control. Now, a solution to this problem by the present embodiment will be described hereinafter.

Conventionally, there has been proposed a tape printing apparatus which is capable of producing a label or the like having a predetermined length. Further, there has been also proposed one which is capable of setting the length of a front margin (front margin length) from a leading edge of a tape as a label material to a print start position thereon, and the length of a rear margin (rear margin length) from a print end position on the tape to a cutting position thereon at which the printed portion of the tape is cut off to form a label.

Further, there has been proposed another type of tape printing apparatus which is capable of setting the length of a label (tape length), a front margin length and the length of a printed image (print length) instead of setting a rear margin length, and thereafter calculating the rear margin length to set the same. In theory, if three of a tape length, a front margin length, a print length and a rear margin length are determined, the remaining one can be calculated.

Furthermore, there has been also proposed another which sets only two of a tape length, a front margin length and a print length, because determination of two of the tape length, the front margin length and the print length enables determination of the remaining two provided that the front margin length and a rear margin length are set to an identical value from a viewpoint of the appearance of a label.

To carry out the fixed length control for these type of tape printing apparatuses, it is required that based on a tape length, a front margin length, a print length and a rear margin length, which are finally determined (set), a front margin having the determined front margin length is provided (by feeding the tape T) from the front end (leading edge) of the tape T to start printing of a print image from a print start position (rear end of the front margin), and after printing the print image on the tape T over the predetermined tape length, a rear margin having the determined rear margin length is provided (by feeding the tape T) to cut the tape T at a cutting position (rear end of the rear margin).

In the above description, for purposes of simplifying the description other than that of heating control, it is assumed that the printing-terminating process is carried out only by turning off the DC motor 121, without contemplating execution of the fixed length printing. Actually, according to the tape printing apparatus 1, as described above, the form-setting selection screen displayed by depressing the form key (or alternatively the form-setting selection screen displayed by depressing the fixed length-setting key, the tape length-setting screen displayed by depressing the tape length-setting key, the front margin-setting screen displayed by depressing the front margin-setting key, or the rear margin-setting screen displayed by depressing the rear margin-setting key) can be used to set the tape length, the front margin length, the rear margin length, and so forth.

In the following, description will be made of the solution to the second problem caused by the use of the DC motor 121 as the drive source for the apparatus, that is, a method of producing a label or the like having a length adapted to a predetermined tape length.

First, similarly to the conventional printing apparatuses, if a stepping motor (pulse motor) which is capable of speed control (constant speed control) by the number of pulses of a pulse signal or a so-called DC servo motor incorporating a constant speed control circuit is employed as the drive source for the relative motion means for moving at least one of a print head (thermal head) and a print material (tape) relative to the other, it is possible to move the print head and/or the print material at a constant relative speed from a time point of starting the relative movement between the print head and the print material.

More specifically in such a case, it is only required that since the relative speed is constant, a print image starts to be printed after the lapse of time required for feeding the print material (tape) by a predetermined front margin length, and after printing the print image over a predetermined print length at the constant speed, the print material (tape) is further relatively moved (fed) for a time period required for feeding the same by a predetermined rear margin length to thereafter stop the relative movement (feeding of the tape) and cut the print material (tape) at a stop position as a cutting position. However, in the above tape printing apparatuses, it is required to use a relatively expensive motor, which prevents the reduction of the manufacturing costs of the apparatuses.

Therefore, in the tape printing apparatus 1, a relatively inexpensive DC motor is employed as the drive source for the relative motor means. However, since the DC motor 121 has no constant speed control circuit, it is required to exercise ingenuity so as to solve problems in feeding a tape by the length of a predetermined front margin, printing over a predetermined print length, feeding the tape by the length of a predetermined rear margin after the printing, and so forth. Among these problems, those associated with the front margin length and the print length can be solved by starting the printing operation at a position corresponding to a rear end of a preset or determined front margin and printing the predetermined print length at a print timing suitable for varied relative speeds in the FIG. 18 printing process.

On the other hand, to stop feeding of the tape, it is required to turn off the DC motor 121. However, as described above, even after the power is turned off, the DC motor 121 continues to rotate by inertia for a while, and hence whether or not a tape (label) having a length equal to a set or determined length (predetermined length) can be created depends on how to control the rotation caused by inertia.

Further, the inertia force is changed by the rotational speed (relative speed or printing speed) of the DC motor 121, the load of a tape T (the strength of force required for drawing out the tape T), and an ambient temperature Td, among which the rotational speed of the DC motor 121 makes the largest contribution to the change in the inertia force.

Therefore, in the tape printing apparatus 1, braking process is carried out in a plurality of steps based on braking data before stopping feeding of the tape, whereby the rotational speed of the DC motor 121 is reduced to a predetermined value, and then a final braking process is executed.

Figure 21:
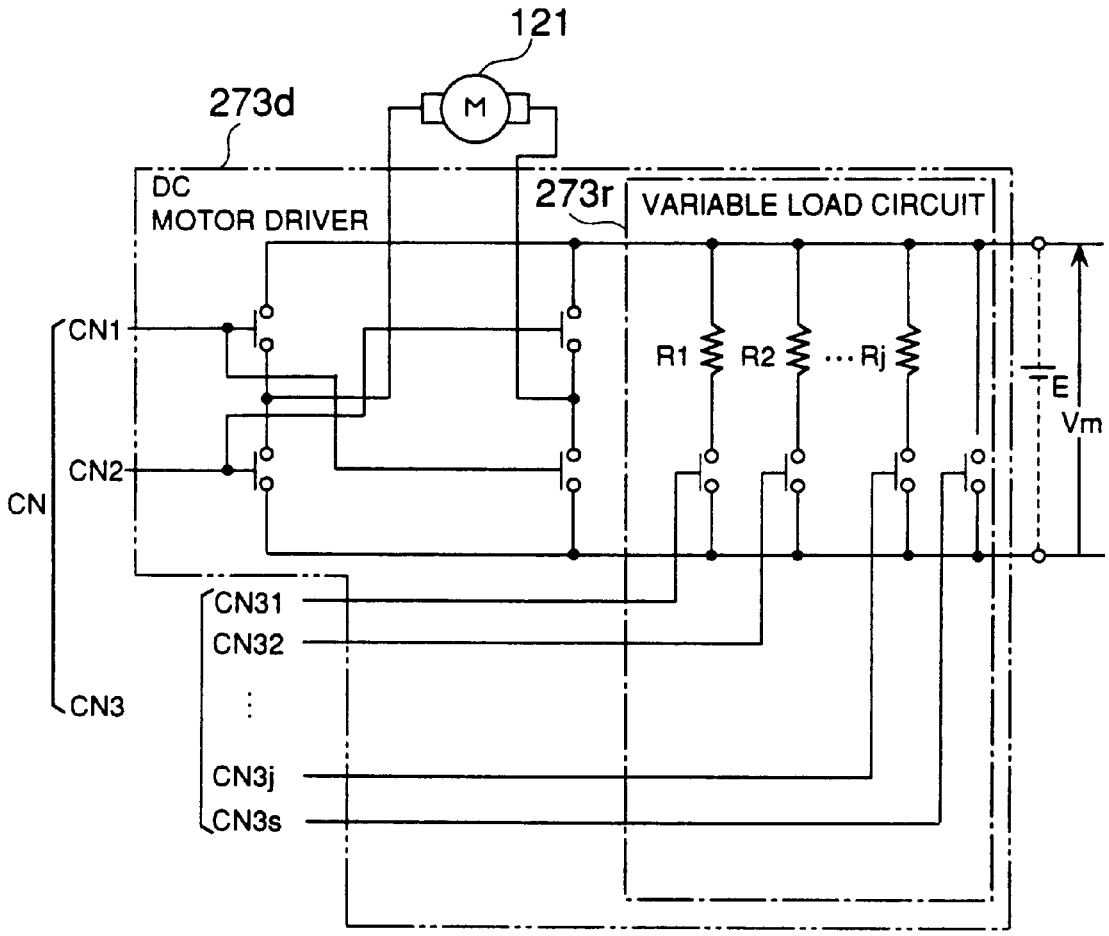
FIG. 21 is a diagram showing an example of a circuit of a DC motor driver.

In the following, the braking processes will be described with reference to FIGS. 21 to 23. First, the DC motor driver 273*d*, described hereinbefore with reference to FIG. 7, is configured, e.g. as shown in FIG. 21, to incorporate a variable load circuit 273*r*.

The DC motor driver 273*d* has a driving voltage Vm applied thereto by a power supply E of the power supply unit and drives the DC motor 121 in response to a control signal CN from the P-CON (peripheral control circuit) 250, described hereinabove with reference to FIG. 7.

The control signal CN is comprised of control signals CN1, CN2 and CN3, and further the control signal CN3 is comprised of control signals CN31, CN32, . . . , CN3*j* ($j \geqq 1$), and CN3*s*.

The control signals CN1 and CN2 are signals for controlling ON-OFF states of the DC motor 121 and the direction of rotation thereof. When [CN1, CN2]=[OFF, OFF], a standby mode is instructed to turn off the DC motor 121.

Further, when [CN1, CN2]=[OFF, ON], a CW mode is instructed and the DC motor 121 is rotated in a normal direction (in the clockwise direction) such that the same is rotated in the direction of feeding of the tape, whereas when [CN1, CN2]=[ON, OFF], a CCW mode is instructed and the DC motor 121 is rotated in a reverse direction (in the counterclockwise direction).

When the above CW mode is switched to the CCW mode, the normal rotation of the DC motor 121 is braked, and hence in the tape printing apparatus 1, the CCW mode is treated as a kind of braking load (reverse rotation load), described hereafter.

The control signal CN3 is a signal for changing the braking load on the DC motor 121 to thereby control the braking of the same. When the control signal CN3*s* is turned ON, a full load instruction for short-circuiting the variable load circuit 273*r* is given. Further, when the control signal CN31, CN32, . . . , or CN3*j* is turned on, it gives an instruction for selecting a braking load R1, R2, . . . or Rj.

Figure 22A:
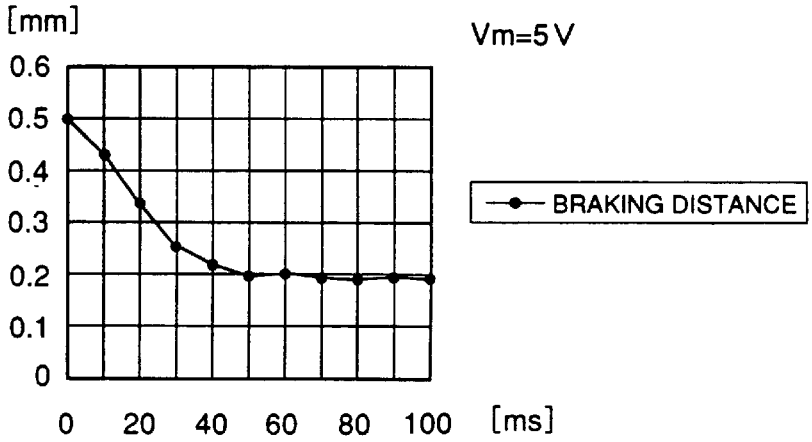
FIGS. 22A and 22B are diagrams showing examples of data obtained from actual measurements of braking distances.
Figure 22B:
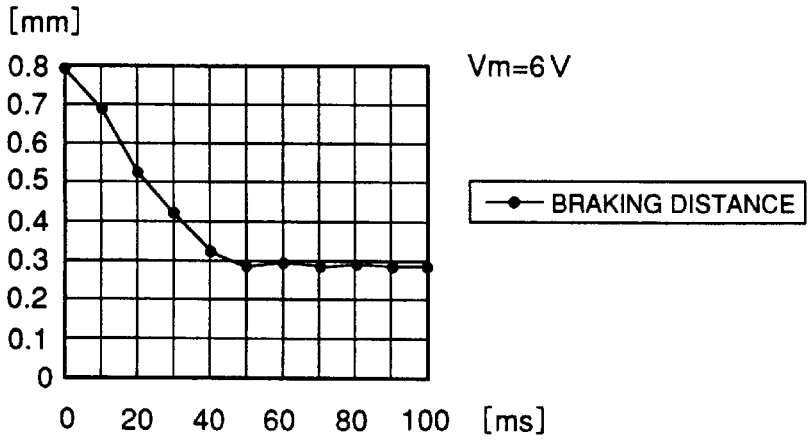

Now, for instance, assuming that the CW mode is switched to the standby mode and immediately thereafter the standby mode is switched to the CCW mode, the relationship between a time period (reverse rotation-braking time period) during which the state of the reverse rotation load is maintained, and a braking distance between a position at which the CCW mode is switched to the full load instruction (full load braking) and a position at which the DC motor 121 is completely stopped (by the full load braking over 300 msec according to actual measurements) is represented by graphs of FIGS. 22A and 22B plotted based on data of actual measurements of the braking distance.

In these figures, the abscissa indicates the reverse rotation-braking time period and the ordinate indicates the braking distance measured under a full load condition after the reverse rotation-braking time period. For instance, in the case of the driving voltage Vm=5 V, if the reverse rotation-braking time period is set to 50 msec or longer as shown in FIG. 22A, the braking distance is equal to 0.2 mm. FIG. 22B similarly shows the relationship between the reverse rotation-braking time period and the braking distance, in the case of driving voltage Vm=6 V.

It should be noted that as shown in the figure, the braking distance does not change or becomes shorter than a limit even if the braking is carried out in excess of a certain value (50 msec according to the illustrated examples of the reverse rotation-braking time period. This is because the tape cartridge 5 is constructed such that it does not permit rewinding of the tape T so as to prevent formation of looseness of the tape T due to the rewinding, occurrence of jamming in a printing operation executed next time, resulting breakage of the tape T and an ink ribbon, and defective printing.

Now as shown in FIG. 22A, the braking distance is 0.5 mm, for instance, when the reverse rotation-braking time period is not provided (0 msec), whereas it becomes equal to 0.2 mm when the reverse rotation-braking time period is set to 50 msec, so that in this case the braking distance is shortened by 0.3 mm. Further, to stop the tape T at a predetermined length end position, it is only required that the reverse rotation-braking is started 50 msec before it is switched to the full load braking at a position 0.2 mm backward of a predetermined length end position.

In short, by obtaining such data as described above from actual measurements not only in the case of application of the reverse rotation load but also the cases of applications of other braking loads and providing the data in the form of a table, it is possible to carry out a braking process with accuracy by using the table.

It should be noted that actually, variations in the manufacturing accuracy of DC motors, driving time periods thereof, changes in an ambient temperature, etc. are taken into account, and the data is provided which compensates for these variations to enhance the accuracy of fixed length printing.

The braking data defines, based on the actual measurement data, a braking distance (in a case where the torque load or braking load is switched to the full load braking) which is set in a manner corresponding to the length of a remaining area of the tape T from the position of the switching up to a predetermined length end position, a braking load to be selected at certain braking timing, a braking time period during which the braking is continued, a braking distance remaining to be covered in such a state, etc.

If the braking data is defined separately for preliminary braking and final braking, described hereinafter, it provides means for coping with differences in the braking distance between a case where printing is carried out and a case where printing is not carried out, thereby making it possible to increase the accuracy of the fixed length control.

Of course, after the tape is stopped, in the case of manual cutting, the cutting button 133 (see FIGS. 1, 2 and 7) is depressed at the predetermined length end position which corresponds to a cutting position, whereby the tape cutter 132 is actuated to cut off the tape T into a desired length. On the other hand, if the automatic cutting mode is selected, the cutter motor 131 is driven for cutting off the tape T upon stoppage of the tape at the predetermined length end position.

Actually, since there is a predetermined distance (head-to-cutter distance) between the printing position (the position of the thermal head 7) and the cutting position (the position of the tape cutter 132) (see FIG. 4), the sum total of a predetermined length set by the user and the head-to-cutter distance is treated as the above predetermined length in the control data.

Therefore, even when the tape T is cut off at a position immediately following a printed portion (rear margin length=0), the tape is required to be advanced by the head-to-cutter distance, which favorably acts on the final braking (since it provides room for braking operation). However, the tape printing apparatus 1 is capable of carrying out a braking operation even if there is no head-to-cutter distance, and hence in the following, description is made without taking the head-to-cutter distance into account. It should be noted that in the following description of this embodiment, "the predetermined length" is used to mean a predetermined length set by the user, based on which the fixed length control is carried out especially in the braking process (printing-terminating process), unless otherwise specified. The predetermined length is set e.g. to a tape length (length from a front end position (leading edge) of a print material to a stop position as a predetermined length end position), a print length+a rear margin length (length from a print start position to a rear end of the tape length), or a rear margin length (length from a print end position to the rear end of the tape length).

In the tape printing apparatus 1, a plurality of braking data items as described above are stored in a manner correlated to values of the predetermined length, initial speeds (initial relative speeds or printing speeds) at a time point of setting a braking distance, ambient temperature values, etc. (hereinafter, the plurality of braking data items are collectively referred to as "the braking data"). Further, as described above, the braking data is also stored in the control data area 222 in the ROM 220.

Next, the printing-terminating process is described with reference to FIG. 23. When the FIG. 18 printing-terminating process is started at step S20, first, as shown in FIG. 23, the value of the timer 251 is obtained at step S201 and a printing speed at this time point is obtained at step S202.

In this process, although the printing speed can be obtained from printing speed data in the above-mentioned manner, the tape printing apparatus 1 is equipped with the encoder 122 and the rotational speed sensor 141, and hence to enhance the braking accuracy by carrying out actual measurements, the printing speed is obtained, in this case, based on results of detection by the encoder 122, etc. at step S202.

Further, since the tape printing apparatus 1 also has the ambient temperature sensor 143 for detecting the ambient temperature Td, the ambient temperature Td may be detected by using the ambient temperature sensor 143 and braking data corresponding to the detected ambient temperature Td may be used in a process described hereinbelow, to thereby further increase the braking accuracy.

When the printing speed is obtained (S202), next, at step S203, a control length is set based on the predetermined length including the tape length and control data corresponding to the printing speed. If the printing operation has been terminated (Yes to S204), the braking load is changed based on the predetermined length and the braking distance to thereby carry out the final braking process at step S205, and thereafter the printing terminating process is completed at step S206 (S20 in FIG. 18), followed by terminating the FIG. 18 printing process (S21).

On the other hand, when the printing operation has not been completed (No to S204), preliminary braking process in which the braking load is changed, similarly to the final braking process, that is, preliminary braking process for controlling or reducing the inertia force of the DC motor 121 before termination of the printing process is carried out at step S207.

When the preliminary braking process is terminated (S207), the printing operation is carried out similarly to the FIG. 18 loop process at steps S208 to 213.

More specifically, print data Di (D1) on an i-th line of dots is transmitted to the head driver 272 (S208: similar to S13 in FIG. 18), and timing of printing the i-th line of dots of the print data Di is awaited with reference to a value of the timer 251 (S209 to S210: S14 to S15). When the print timing (Yes to S210) has reached, the parameter of the strobe pulse STB is set at step S211 (S16), and the strobe pulse STB is applied to the thermal head 7 based on the parameter and the print data Di, whereby the print data Di is printed at step (S212:S17), and then the variable i is incremented (i=i+1) and the variable n is decremented (n=n−1) (S213:S18).

Thereafter, a value of the timer 251 and a printing speed at this time point are obtained again at S201 and step S202, respectively, and the control length is set based on the control data at step 203. If the printing process has been terminated (Yes to S204), the final braking process is carried out at step S205 to terminate the present process at step (S206:S20 in FIG. 18). When the printing process has not been terminated (No to S204), the preliminary braking process is executed at step S207, to further carry out the printing operation at step S208 to S213.

As described above, in the tape printing apparatus 1, the tape (print material) T is moved relative to the thermal head (print head) 7 at a relative speed determined based on the rotational speed of the DC motor 121 as the drive source, and at the same time a print image is printed on the tape T by using the thermal head 7 in response to the dot information of the print image. Further, the tape length and the like are set to the predetermined length and according to the predetermined length and the printing speed (relative speed), the braking load of the DC motor 121 is changed.

In the above embodiment, by changing the braking load of the DC motor 121, the braking time period from starting time to stopping time (of the relative movement) can be changed, which makes it possible to control a length between a relative position at the braking-starting timing and the relative position at the stopping time, that is, a braking distance.

Further, since the braking load is changed according to the relative speed between the print head and the tape T, the braking load can be adjusted to a desired braking distance, even if the relative speed is not constant (changed). Furthermore, since the braking load is changed according to the predetermined length, it is possible to switch between quick braking and slow braking depending on whether the predetermined length is long or short or carry out a multi-stage braking process according to the distance to the predetermined length end position, which enhances the freedom of braking control.

Therefore, the relative movement can be stopped at a desired predetermined length end position corresponding to a predetermined length, which is set for the printing, which makes it possible to execute a fixed length control adapted to various lengths set beforehand as well as reduce the manufacturing cost of the tape printing apparatus 1 by using the DC motor 121 as the drive source.

Figure 23:
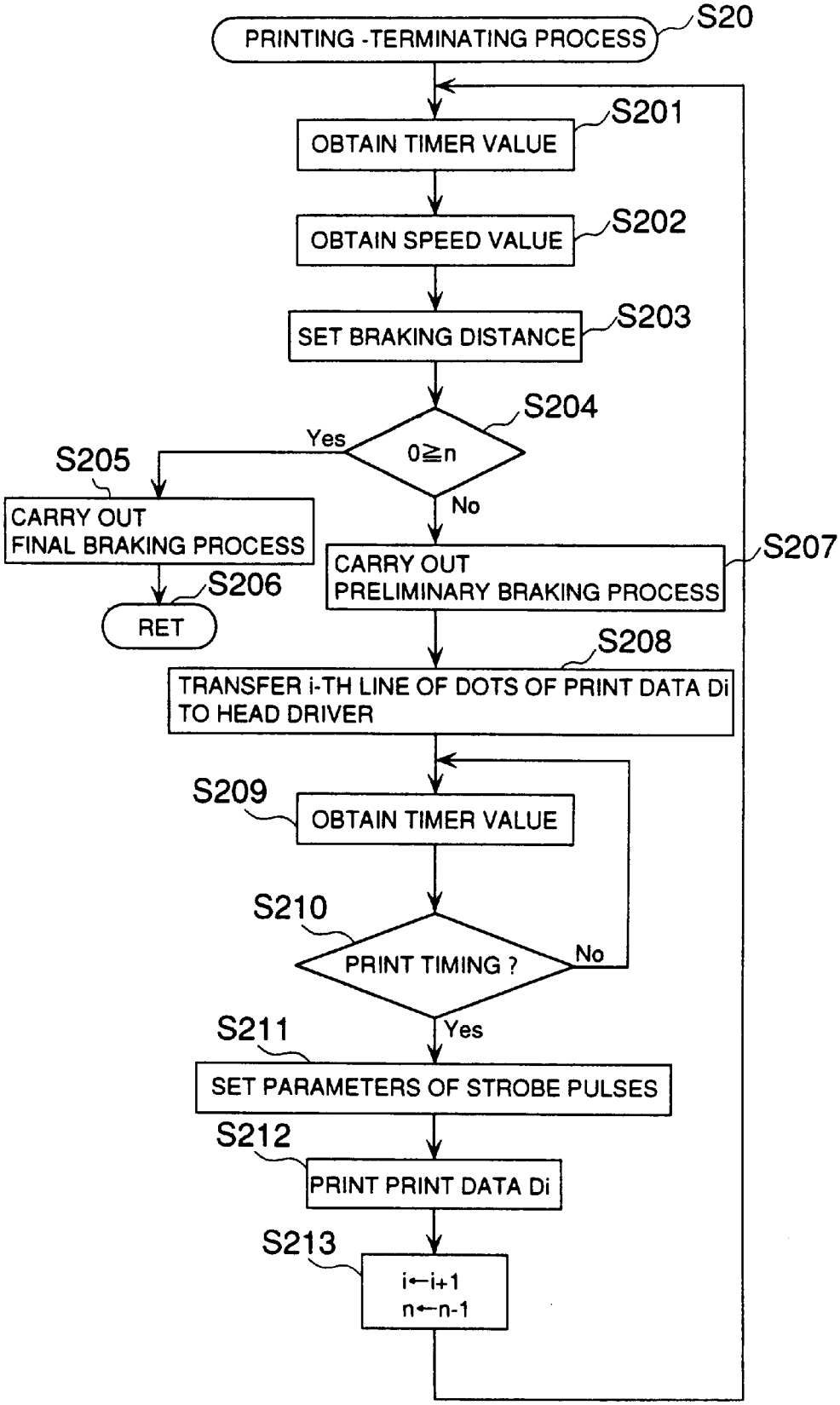
FIG. 23 is a flowchart showing a printing-terminating process.

Furthermore, in the tape printing apparatus 1, a braking distance from a braking distance-starting position for starting the braking of the DC motor 121 to a predetermined length end position is set according to the predetermined length and the relative speed at step 203 in FIG. 23, and based on the predetermined length and the braking distance, the braking of the DC motor 121 is started at step S205 or 207.

In this case, a predetermined length end position which is distant from a predetermined length start position (e.g. a leading edge of the tape T) by the predetermined length (for instance, a tape length), and a predetermined length end position (stop position) which is distant from the braking distance-starting position by the braking distance can be made coincident with each other.

For example, when the predetermined length is large, the slow braking process and the multi-stage braking process can be started at the predetermined length end position, so that by setting the braking distance according to the relative speed and changes the braking load according to the braking distance, it is possible to stop the tape T at the predetermined length end position. On the other hand, when the predetermined length is small, since it is required to brake the DC motor 121 before a rear end thereof is reached, so that the quick braking is carried out to the predetermined length.

That is, according to the tape printing apparatus 1, it is possible to switch between quick braking and slow braking according to the length of the predetermined length or carry out a multi-stage braking process according to the distance to the predetermined length end position, whereby the freedom of the braking control is enhanced. This makes it possible to carry out a fixed length control in a manner adapted to various lengths.

Generally, when the braking distance is larger than a length from a print end position to a predetermined length end position, i.e. when the braking distance is larger than a so-called rear margin length, unless the braking process is started before printing operation comes to an end, it is impossible to stop the relative movement immediately after providing a rear margin having a desired rear margin length.

According to the tape printing apparatus 1, the preliminary braking (S207 in FIG. 23) carried out before termination of the printing operation and the final braking (S205 in the figure) carried out after termination of the printing operation are included in the braking process for braking the DC motor 121. For instance, the DC motor 121 is braked or reduced in speed to a speed which permits braking distance corresponding to a rear margin length, more specifically, to a relative speed at which the DC motor 121 can be stopped within the braking distance, during the stage of the preliminary braking before termination of the printing operation, whereby it becomes possible to stop the tape T at a predetermined length end position by the final braking carried out after termination of the printing operation. This enables the fixed length control to be carried out with a higher accuracy.

In the above embodiment, it is only required that timing for setting the braking distance is provided before braking-starting timing. Further, for accuracy of the braking distance, it is preferred that the timing is set based on a value of the relative speed at a time close to (immediately before) the braking-starting timing. Furthermore, since thus set timing enables the braking process to be started immediately after setting the braking distance, there is no need to store the braking distance for a long time period. This increase the efficiency of the control process.

When the tape length (the length of a print material from a front end (leading edge) of the tape material to a stop position thereon as a predetermined length end position) is set to the predetermined length, the tape length (predetermined length) includes a front margin length, a print length, and a rear margin length, which makes it possible to set braking distance-setting timing, braking-starting timing and the like regardless of the rear margin length, based on the dot information of a print image and the predetermined length.

If the fixed length control is carried out e.g. based on the number of lines of dots remaining to be printed, particularly of the dot information of a print image, the fixed length control has a specific correlation with printing control, so that the control process can be carried out with higher efficiency. The same applies to a case where the predetermined length defines a length starting from a print start position.

Therefore, in the tape printing apparatus 1, in addition to the variable n of the total number of lines of dots of a print image, the variable M of the line number of a line of dots from which the printing-terminating process is started is set to e.g. 2 (M=2) upon initialization when the FIG. 18 printing process is started, and when the variable n has become equal to the variable M (=2) (Yes to S19), the program proceeds to the FIG. 23 printing-terminating process (S20).

That is, the program proceeds to the FIG. 23 printing-terminating process for carrying out the fixed length control, particularly the braking control, based on the number M of lines of dots remaining to be printed, and the braking distance is set according to the predetermined length and the printing speed (relative speed) at step S203. Then, based on the predetermined length and the braking distance, the braking of the DC motor 121 is started at step S205 or S207.

Further, when a rear margin length (predetermined length from a print end position) is set, by setting the above variable M to 0 (M=0) to thereby cause the program to proceed to the FIG. 23 printing-terminating process after printing the total number of lines of dots, whereupon the braking distance can be set according to the predetermined length.

In this case, the flow of the printing process may be modified such that immediately after the program proceeds to the FIG. 23 printing-terminating process, it is determined (at a stop corresponding to step S204) whether or not the printing operation has been terminated, and then, based on the predetermined length, a step (corresponding to step S201) for obtaining a value of the timer 251 to a step (corresponding to step S203) for setting a braking distance are executed. In this case, the braking distance-setting timing and the braking-starting timing are set according to the predetermined length.

Particularly, when the rear margin has a large length, more than enough time can be taken for braking operation, so that for purposes of enhancing the accuracy of the braking distance, it is preferred that the braking distance-setting timing is set based on a value of the relative speed detected at a time point close to the braking-starting timing (immediately before the start of the final braking process (S205) for stopping the DC motor 121). Furthermore, since this braking distance-setting timing enables the braking process to be started immediately after setting the braking distance, there is no need to store the braking distance for a long time period, leading to the improved efficiency of the control process.

In short, if the rear margin length is set, prior to starting the printing process is large, the printing process can be configured such that the braking distance-setting timing and the braking-starting timing can be set based on the rear margin length.

On the other hand, even when the rear margin length (a predetermined length from a print end position) is set, if the rear margin length is small, the braking distance-setting timing and the braking-starting timing can be more suitably set based on the dot information of a print image to be printed before the rear margin is reached, e.g. by setting the variable M to 2 (M=2), as described above with reference to FIG. 23. This enables more than enough time to be taken for braking operation.

As described above, in any of the case where a tape length (the length from a front end (leading edge) of a print material to a stop position as a predetermined length end position) is set to the predetermined length, the case where a print length+a rear margin length (length from a print start position) is set to the predetermined position, and the case where a rear margin length (length from a print end position) is set to the predetermined length, by properly setting the variable M of the line number of a line of dots from which the printing-terminating process, described above with reference to FIG. 18, is started, the braking distance-setting timing can be suitably set based on the dot information of a print image and/or the predetermined length. As a result, the braking distance can be more suitably and accurately set with higher efficiency, which enables the fixed length control to be more suitably carried out.

Although the above description made with reference to FIG. 8 assumes that interrupt handling responsive to key entries is carried out, this is not limitative, but the same control process can be realized by other methods, such as a method of management of independent programs for respective different processes, by multitask processing.

Further, as a tape fed from a tape cartridge, there may be employed not only a release paper (peel-off paper) backed adhesive tape but also a tape without using a release paper (peel-off paper), such as a transfer tape and an iron print transfer tape, which are commercially available.

Furthermore, the printing method and device according to the invention can be applied to a stamp making apparatus other than a tape printing apparatus. That is, the printing method and device can also be applied to a stamp making apparatus which is capable of printing mask data items for obtaining a stamp image to be formed on the stamping face of a stamp. Further, the above-mentioned heating control for controlling the amount of heat produced by the heating elements of the thermal head can be applied to an apparatus other than a tape printing apparatus, as its printing method and device, so long as the apparatus carries out printing on a print material by using a thermal head.

Although in the above embodiments a tape as a print material is moved, this is not limitative, but the printing method and device according to the invention can be applied to a printing apparatus of a type which carries a thermal head e.g. on a carriage or the like for moving the thermal head relative to a print material fixedly set, or alternatively the same may be applied to a printing apparatus of a type which moves both the tape as a print material and the thermal head relative to each other.

Further, the above heating control method and device can be applied to a tape printing apparatuses, irrespective of a specific printing method, such as a sublimation thermal transfer method which sublimates ink and a melting thermal transfer method, so long as the tape printing apparatus carries out printing by using heating elements of thermal heads. Even when a print material is a heat sensitive paper, printing can be effected by generating an amount of heat within a predetermined range, sufficient to suitably change the color of a printed portion of the paper and directly applying the heat to the print material.

Furthermore, although in the above embodiment, the thermal head is used as a print head, the above-mentioned driving/braking control of the DC motor can be applied to cases in which a print head of another type is employed.

In this case, the printing control is more simplified. For instance, when a print head of an ink jet type is used, there is no need to control the amount of generated heat or timing of generation of the heat, but it is only required to control of print timing, and hence pulses (corresponding to the above strobe pulse) applied to the print head during printing operations may have an identical width and voltage.

Of course, in this case as well, by changing the print timing based on the predetermined length according to a change in the relative speed between the print heat and the print material, printing of a print image can be carried out in a manner adapted to a front margin length, a printing length and a rear margin length, each of which is set based on the predetermined length, even if the relative speed is not constant (changed). Further, if cutting means for cutting a print material at a predetermined length end position is provided, similarly to the embodiments described above, the printing method and device according to the invention can be applied not only to a case where the print material is a cut sheet but also a case where the print material is a continuous sheet.

As described above, the printing method and device according to the invention enable the reduction of the manufacturing costs of an apparatus as well as execution of fixed control in a manner adapted to the predetermined length.

It is further understood by those skilled in the art that the foregoing is a preferred embodiment of the invention, and that various changes and modifications may be made without departing from the spirit and scope thereof.

What is claimed is:

1. A method of printing a print image on a print material by using a print head based on dot information of said print image by causing at least one of said print head and said print material to move to thereby effect relative motion between said print head and said print material at a relative speed dependent on a rotational speed of a DC motor as a drive source, the method comprising the steps of:

controlling driving of said DC motor and said print head for printing of said print image;

setting a first length to a distance from a start position to an end position at which said relative motion is to be terminated, the start position being selected from a front end position, a print start position, and a print end position of said print material; and controlling braking of said DC motor by varying a braking load on said DC motor in depending on at least said relative speed and said first length so as to terminate said relative motion at said end position.

2. A method according to claim 1, wherein the step of controlling the braking of said DC motor comprises the steps of:

calculating a braking distance over which the braking of said DC motor is carried out based on said first length and said relative speed, said braking distance starting from a brake start position at which the braking of said DC motor is started and terminating at said end position; and starting the braking of said DC motor based on said first length and said braking distance.

3. A method according to claim 2, wherein when said braking distance is longer than a distance from said print end position to said end position, the braking of said DC motor includes preliminary braking carried out before completion of the printing of said print image and final braking carried out after said completion of the printing.

4. A method according to claim 2 or 3, wherein the step of controlling the braking of said DC motor further includes the step of setting timing of setting said braking distance based on one of said dot information of said print image and said first length.

5. A method according to claim 1, wherein the step of controlling the braking of said DC motor includes changing timing of printing each line of dots in dependence on a variation in said relative speed.

6. A method according to claim 1, including the step of cutting off said print material at said end position.

7. A method according to claim 1, wherein said print material is a tape.

8. A method according to claim 1, wherein said braking load includes driving of said DC motor in a reverse direction.

9. A method according to claim 1, wherein said braking load includes a plurality of resistances for selective connection in a circuit via which power is supplied to said DC motor.

10. A method according to claim 8, wherein said braking load includes a plurality of resistances for selective connection in a circuit via which power is supplied to said DC motor.

11. A method according to claim 10, wherein said braking load is changed based on data of actual measurement of effects on said relative motion caused by the driving of said DC motor in said reverse direction and the selective connection of said plurality of resistances.

12. A method according to claim 5, wherein said variation in said relative speed is detected based on detection of said relative speed by using a sensor.

13. A printing apparatus comprising:

a DC motor as a drive source;

printing means having a print head, said printing means printing, based on dot information of a print image, said print image on a print material;

relative motion means driven by said DC motor for causing at least one of said print head and said print material to move to thereby effect relative motion between said print head and said print material at a relative speed dependent on a rotational speed of said DC motor;

drive control means for controlling driving of said DC motor and said print head for printing of said print image;

fixed length-setting means for setting a first length to a distance from a start position to an end position at which said relative motion is to be terminated, the start position being selected from a front end position, a print start position, and a print end position of said print material; and control means for controlling braking of said DC motor by varying a braking load on said DC motor depending on said relative speed and said first length so as to terminate said relative motion at said end position.

14. A printing apparatus according to claim 13, wherein said control means includes:

braking distance-setting means for setting a braking distance over which the braking of said DC motor is carried out based on said first length and said relative speed, said braking distance starting from a brake start position at which the braking of said DC motor is started and terminating at said end position; and braking start means for starting the braking of said DC motor based on said first length and said braking distance.

15. A printing apparatus according to claim 14, wherein said control means preliminarily brakes said DC motor before completion of the printing of said print image and said control means carries out final braking after said completion of the printing, when said braking distance is longer than a distance from said print end position to said end position.

16. A printing apparatus according to claim 14 or 15, wherein said control means further includes braking distance-setting timing-setting means for setting timing of setting said braking distance based on at least one of said dot information of said print image and said first length.

17. A printing apparatus according to claim 13, wherein said control means includes print timing-changing means for changing timing of printing each line of dots by said print head depending on a variation in said relative speed.

18. A printing apparatus according to claim 13, further including cutting means for cutting off said print material at said end position.

19. A printing apparatus according to claim 13, wherein said print material is a tape.

20. A printing apparatus according to claim 13, wherein said control means includes means for driving said DC motor in a reverse direction as said braking load.

21. A printing apparatus according to claim 13, including a circuit via which power is supplied to said DC motor, and wherein said braking load includes a plurality of resistances for selective connection in said circuit.

22. A printing apparatus according to claim 20, including a circuit via which power is supplied to said DC motor, and wherein said braking load includes a plurality of resistances for selective connection in said circuit.

23. A printing apparatus according to claim 22, wherein said control means includes means for changing said braking load based on data of actual measurement of effects on said relative motion caused by driving said DC motor in said reverse direction and the selective connection of said plurality of resistances.

24. A printing apparatus according to claim 17, including a sensor for detecting said relative speed to detect said variation in said relative speed based thereon.

25. A method according to claim 2 or 3, wherein the step of controlling the braking of said DC motor further includes the step of setting timing of setting said braking distance based on said dot information of said print image and said first length.

26. A method of printing according to claim 1, wherein the step of controlling braking of said DC motor includes the step of selectively executing one of a plurality of braking processes depending on said relative speed and said first length so as to terminate said relative motion at said end position.

27. A method of printing according to claim 26, wherein the one of a plurality of braking processes starts before termination of printing the print image on the print material.

28. A printing apparatus according to claim 26, wherein the one of a plurality of braking processes starts when the relative motion between said print head and said print material is not constant.

29. A printing apparatus according to claim 13, wherein said control means includes execution means for selectively executing one of a plurality of braking processes depending on said relative speed and said first length so as to terminate said relative motion at said end position.

30. A printing apparatus according to claim 29, wherein said execution means starts the one of a plurality of braking processes before termination of printing the print image on the print material.

31. A printing apparatus according to claim 29, wherein said execution means starts the one of a plurality of braking processes when the relative motion between said print head and said print material is not constant.

* * * * *

UNITED STATES PATENT AND TRADEMARK OFFICE

CERTIFICATE OF CORRECTION

PATENT NO. : 6,106,176

DATED : August 22, 2000

INVENTOR(S) : Shigekazu Yanagisawa; Yoshio Karasawa; Kenji Watanabe; Tomoyuki Ichikawa; Kenichi Tanabe; Rie Sudo It is certified that error appears in the above-identified patent and that said Letters Patent is hereby corrected as shown below:

On the front page, Col. 1, in line 75 under Inventors, the residence for Shigekazu Yanagisawa of Matsumoto is incorrect. The correct residence is Nagano. The residence for Yoshio Karasawa of Yamagata-mura is incorrect. The correct residence is Nagano.
On the front page, Col. 1, in line 73, under Assignee, one of the Assignee was omitted. Please add King Jim Co., Ltd. in that section along with Seiko Epson Corporation.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*